US007857743B2

(12) United States Patent
Barner

(10) Patent No.: US 7,857,743 B2
(45) Date of Patent: Dec. 28, 2010

(54) BLANK, APPARATUS AND METHOD FOR CONSTRUCTING CONTAINER

(75) Inventor: James W. Barner, Cumming, GA (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 953 days.

(21) Appl. No.: 11/392,128

(22) Filed: Mar. 29, 2006

(65) Prior Publication Data

US 2007/0228119 A1 Oct. 4, 2007

(51) Int. Cl.
*B31B 1/28* (2006.01)

(52) U.S. Cl. ..... 493/175

(58) Field of Classification Search ..... 493/175, 493/176, 143, 295, 153, 296, 305
See application file for complete search history.

(56) References Cited

U.S. PATENT DOCUMENTS

| | | | | | |
|---|---|---|---|---|---|
| 484,041 | A * | 10/1892 | Stutsman | 493/175 |
| 3,018,702 | A * | 1/1962 | Bauder | 493/93 |
| 3,854,583 | A * | 12/1974 | Amberg et al. | 206/520 |
| 3,999,469 | A * | 12/1976 | Nilsson | 493/164 |
| 4,053,346 | A * | 10/1977 | Amberg et al. | 156/446 |
| 4,932,930 | A * | 6/1990 | Coalier et al. | 493/128 |
| 4,945,007 | A | 7/1990 | Coalier et al. | |
| 5,120,292 | A * | 6/1992 | Ueda et al. | 493/124 |
| 5,147,271 | A | 9/1992 | Bacques et al. | |
| 5,295,623 | A | 3/1994 | Bacques et al. | |
| 5,381,948 | A | 1/1995 | Coalier et al. | |
| 5,395,043 | A | 3/1995 | Bacques et al. | |
| 5,704,540 | A | 1/1998 | Coalier et al. | |
| 5,878,946 | A | 3/1999 | Frerot et al. | |
| 5,943,840 | A * | 8/1999 | Nilsson et al. | 53/133.2 |
| 6,257,411 | B1 | 7/2001 | Bacques et al. | |
| 6,339,914 | B1 * | 1/2002 | Fujikawa et al. | 53/565 |
| 6,358,191 | B1 | 3/2002 | Greever | |
| 6,394,742 | B1 | 5/2002 | Buscema | |
| 6,887,191 | B2 * | 5/2005 | Bressler et al. | 493/176 |

* cited by examiner

*Primary Examiner*—Sameh H. Tawfik
(74) *Attorney, Agent, or Firm*—Armstrong Teasdale LLP

(57) ABSTRACT

An apparatus for constructing a container from a continuous blank of sheet material including a plurality of panels coupled together at a plurality of fold lines is provided. The apparatus includes a mandrel that is rotatable about a rotational axis. The mandrel includes a rotary head that defines a plurality of exterior surfaces each corresponding to a panel of the continuous blank of sheet material. The rotary head forms an opening in at least one exterior surface configured to receive at least one panel for facilitating forming the blank of sheet material into a configuration with respect to a shape of the rotary head as the mandrel rotates about the rotational axis.

37 Claims, 20 Drawing Sheets

BLANK, APPARATUS AND METHOD FOR CONSTRUCTING CONTAINER

BACKGROUND OF THE INVENTION

This invention relates generally to containers constructed from blanks of sheet material and, more particularly, to apparatus and methods for constructing the containers.

Containers are often used to store, display and/or dispense products, such as confectionary products, bulk products, food condiments or other products. The container is usually filled with the product and closed for transportation to a home, restaurant or retail store. At least some known containers are difficult and time-consuming to manufacture. Accordingly, such containers are costly to manufacture and require human attention in the forming of the container, as well as a more sophisticated forming machine. Moreover, because of the increased costs, at least some containers are simply designed in an effort to reduce costs, manufacturing time and labor, which oftentimes results in reduced functionality of the container.

BRIEF DESCRIPTION OF THE INVENTION

In one aspect, a container for packaging a product is provided. The container includes a continuous blank of sheet material having an interior surface and an opposing exterior surface. The blank of sheet material defines a plurality of side panels each coupled to at least one intermediate side panel at a corresponding fold line. A first intermediate side panel at a first side edge of the blank of sheet material is coupled to a second intermediate side panel at an opposing second side edge of the blank of sheet material to construct the container. The container has a plurality of side walls and a plurality of intermediate side walls each obliquely angled with respect to adjacent side walls of the plurality of side walls. The container defines a cavity.

In another aspect, a container for packaging a product is provided. The container includes a continuous blank of sheet material having an interior surface and an opposing exterior surface. The blank of sheet material defines a plurality of side panels each coupled to at least one intermediate side panel at a corresponding fold line and a divider panel coupled to a first side panel of the plurality of the side panels at a first fold line. The blank of sheet material is configured to form the container having a plurality of side walls and a plurality of intermediate side walls each obliquely angled with respect to adjacent side walls of the plurality of side walls. The container defines a cavity. The divider panel is folded at the first fold line to extend inwardly with respect to the first side panel and is coupled to an interior surface of a second side panel opposing the first side panel at a first manufacturing joint and a third side panel is coupled to the first side panel at a second manufacturing joint to at least partially define the cavity.

In another aspect, a container for packaging a product is provided. The container includes a continuous blank of sheet material having an interior surface and an opposing exterior surface. The blank of sheet material defines a plurality of side panels each coupled to at least one intermediate side panel at a corresponding fold line. The blank of sheet material further defines a divider panel coupled to a first side panel of the plurality of the side panels at a first fold line and coupled to a second side panel of the plurality of side panels at a second fold line parallel to the first fold line. The blank of sheet material is configured to form the container having a plurality of side walls and a plurality of intermediate side walls each obliquely angled with respect to adjacent side walls of the plurality of side walls. The container defines a cavity. The divider panel is folded at each of the first fold line and the second fold line to extend through the cavity. A third side panel is coupled to the first side panel at a first manufacturing joint to form a first side wall of the plurality of side walls and a fourth side panel is coupled to the second side panel to form a second side wall of the plurality of side walls opposing the first side wall.

In another aspect, an apparatus for constructing a container from a continuous blank of sheet material including a plurality of panels coupled together at a plurality of fold lines is provided. The apparatus includes a mandrel that is rotatable about a rotational axis. The mandrel includes a rotary head that defines a plurality of exterior surfaces. Each exterior surface corresponds to a panel of the plurality of panels. The rotary head forms an opening in at least one exterior surface that is configured to receive at least one panel for facilitating forming of the blank of sheet material into a substantially fixed configuration with respect to a shape of the rotary head as the mandrel rotates about the rotational axis.

In another aspect, a method for constructing a container using a machine is provided. The method includes providing a blank of sheet material including a plurality of panels coupled together at a plurality of fold lines. A first panel of the plurality of panels is positioned within an opening formed in a rotary head of the machine. The rotary head is mounted on a mandrel that is rotated about a rotational axis between about 0° and about 450° to construct the container.

DETAILED DESCRIPTION OF THE INVENTION

Figure 1:
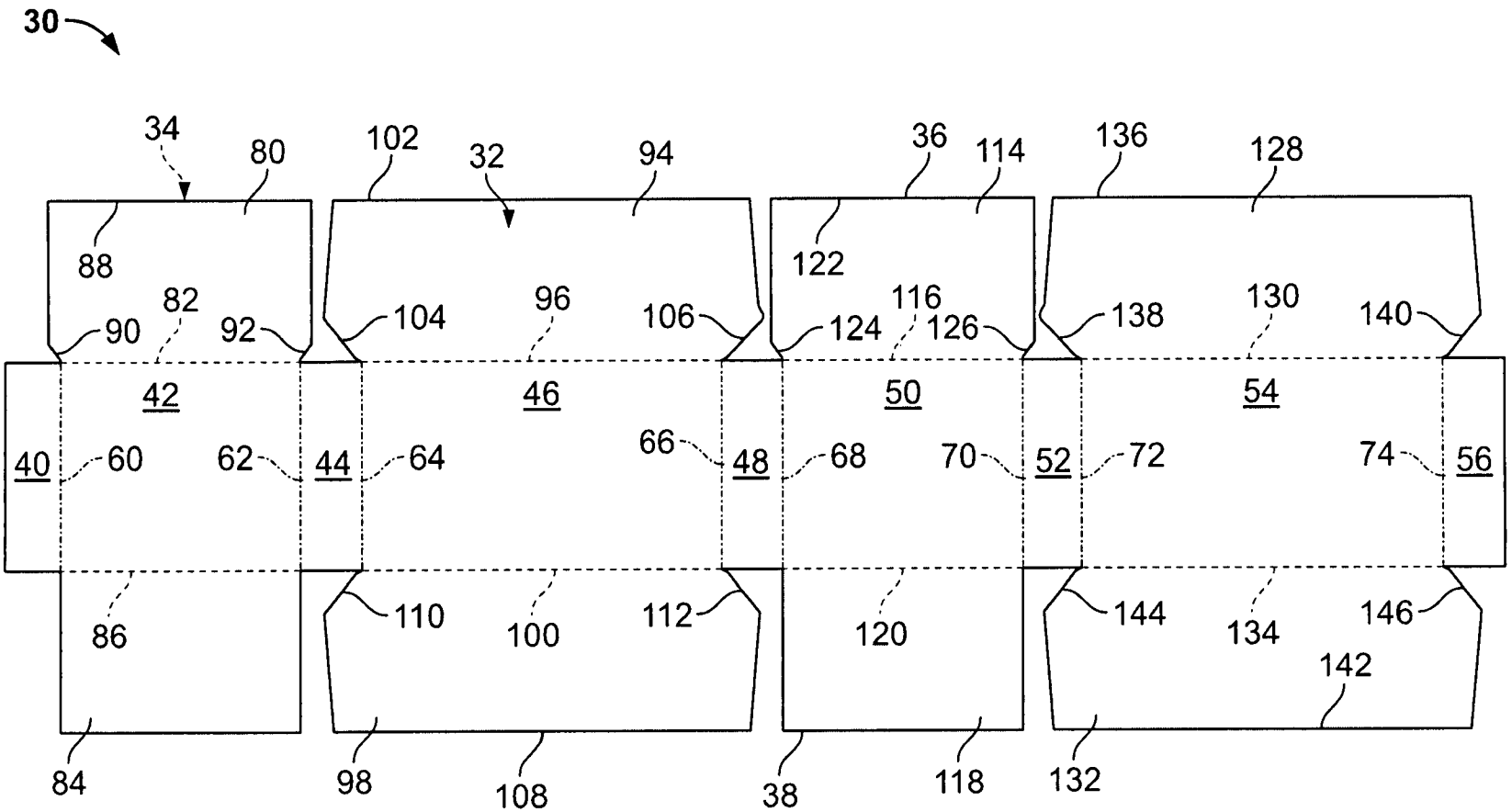
FIG. 1 is a top plan view of an exemplary blank of sheet material.

The present invention provides a container, such as a storage box, a display tray, a dispenser case, a wrap or a sleeve, constructed from a continuous blank of sheet material and an apparatus and method for constructing the container. In one embodiment, the container is constructed or erected using a machine. In a particular embodiment, the construction method utilizes a rotating mandrel and a rotary head coupled to the mandrel. The container is constructed about the rotating rotary head.

The present invention is described below in reference to its application in connection with and operation of a container, such as a box or a sleeve. However, it will be apparent to those skilled in the art and guided by the teachings herein provided that the invention is likewise applicable to any suitable storage and/or display container including, without limitation, a carton, a tray, a sleeve, or a box. Additionally, the storage and/or display container of the present invention may have any suitable number of sides configured in any suitable geometric shape, such as a circle, an oval, a triangle, a square, a rectangle or any suitable polygonal shape, with or without a top and/or a bottom. Further, in one embodiment, the storage and/or display container of the present invention includes a partition or divider that extends through a cavity formed by the container in any suitable direction, such as a lateral, a longitudinal or a diagonal direction. In a particular embodiment, the divider has a height equal to the height of one or more of the container walls. In a particular alternative embodiment, the divider has a height different from the height of one or more of the container walls, i.e., the divider has a height greater than or less than the height of one or more of the container walls.

In one embodiment, the container is fabricated from a paperboard material. The container, however, may be fabricated using any suitable material, and therefore is not limited to a specific type of material. In alternative embodiments, the container is fabricated using cardboard, corrugated board, plastic and/or any suitable material known to those skilled in the art and guided by the teachings herein provided.

In a particular embodiment, the container includes a marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. The container may have any suitable size, shape and/or configuration, i.e. number of sides, whether such sizes, shapes and/or configurations are described and/or illustrated herein. For example, in one embodiment, the container includes a shape that provides functionality, such as a shape that facilitates transporting the container and/or a shape that facilitates stacking and/or arrangement of a plurality of containers.

Figure 2:
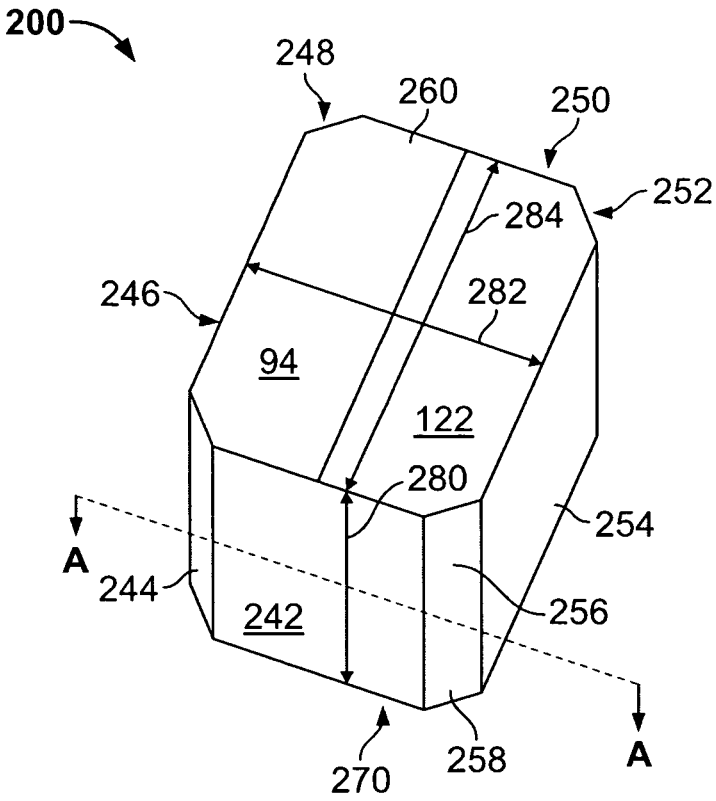
FIG. 2 is a perspective view of a container constructed from the blank shown in FIG. 1.

Referring now to the drawings, and more specifically to FIGS. 1-4, although as described above a container may have any suitable size, shape and/or configuration, FIGS. 1-4 illustrate the construction or formation of one embodiment of a container. Specifically, FIG. 1 is a top plan view of one embodiment of a blank of sheet material 30. FIG. 2 is a perspective view of one embodiment of a container 200 formed from blank 30 shown in FIG. 1.

Referring to FIG. 1, blank 30 has an interior or first surface 32 and an opposing exterior or second surface 34. In one embodiment, first surface 32 is similar or identical to second surface 34 and, thus, first surface 32 and second surface 34 are interchangeable as an exterior surface and an interior surface of blank 30. Further, blank 30 defines a leading edge 36 and an opposing trailing edge 38. In this embodiment, blank 30 has a corrugation direction from leading edge 36 to trailing edge 38. In alternative embodiments, blank 30 has a corrugation direction in any suitable direction. As shown in FIG. 1, blank 30 includes a succession of aligned rectangular side panels 40, 42, 44, 46, 48, 50, 52, 54 and 56 that are connected together by a plurality of preformed, generally parallel fold lines 60, 62, 64, 66, 68, 70, 72 and 74, respectively. Specifically, the aligned rectangular side panels include side panels 42, 46, 50 and 54, and intermediate side panels 40, 44, 48, 52 and 56. In one embodiment, in constructing container 200 from blank 30, intermediate side panels 40 and 56 are coupled together, such as with an adhesive material, at a manufacturing joint to form one intermediate side panel of container 200, as described in greater detail below.

Side panel 42 extends from intermediate side panel 40 along fold line 60, intermediate side panel 44 extends from side panel 42 along fold line 62, side panel 46 extends from intermediate side panel 44 along fold line 64, intermediate side panel 48 extends from side panel 46 along fold line 66, side panel 50 extends from intermediate side panel 48 along fold line 68, intermediate side panel 52 extends from side panel 50 along fold line 70, side panel 54 extends from intermediate side panel 52 along fold line 72 and intermediate side panel 56 extends from side panel 54 along fold line 74. In one embodiment, each fold line 60, 62, 64, 66, 68, 70, 72 and 74 includes a line of weakening including, without limitation, a score line and/or a perforated score line, suitable for facilitating accurate folding and shaping of blank 30 to construct container 200. It is apparent to those skilled in the art and guided by the teachings herein provided that the fold lines described herein may include any suitable line of weakening.

As shown in FIG. 1, a first top flap 80 extends from side panel 42 along a fold line 82 and an opposing first bottom flap 84 extends from side panel 42 along a fold line 86. First top flap 80 includes an outer edge 88 that at least partially defines a perimeter of first top flap 80. Outer edge 88 includes portions 90, 92 that are angled with respect of fold line 86 to correspond to at least a portion of a width parallel with leading edge 36 of intermediate side panel 40 and/or intermediate side panel 44, respectively, with container 200 constructed. In one embodiment, portion 90 and/or 92 contacts respective intermediate side panel 40 or 44 to provide support to container 200. In a particular embodiment, portion 90 and/or 92 is angled at about 45° with respect to fold line 86. In alternative embodiments, portion 90 and/or 92 is angled at a suitable angle with respect to fold line 86 to facilitate forming container 200 in a desired shape or configuration.

A second top flap 94 extends from side panel 46 along a fold line 96 and an opposing second bottom flap 98 extends from side panel 46 along a fold line 100. Second top flap 94 includes an outer edge 102 that at least partially defines a perimeter of second top flap 94. Outer edge 102 includes portions 104, 106 that are angled with respect of fold line 96 to correspond to at least a portion of a width parallel with leading edge 36 of intermediate side panel 44 and/or intermediate side panel 48, respectively, with container 200 constructed. In one embodiment, portion 104 and/or 106 contacts respective intermediate side panel 44 or 48 to provide support to container 200. In a particular embodiment, portion 104 and/or 106 is angled at about 45° with respect to fold line 96. In alternative embodiments, portion 104 and/or 106 is angled at a suitable angle with respect to fold line 96 to facilitate forming container 200 in a desired shape or configuration. Similarly, second bottom flap 98 includes an outer edge 108 that at least partially defines a perimeter of second bottom flap 98. Outer edge 108 includes portions 110, 112 that are angled with respect of fold line 100 to correspond to at least a portion of a width parallel with trailing edge 38 of intermediate side panel 44 and/or intermediate side panel 48, respectively, with container 200 constructed. In one embodiment, portion 110 and/or 112 contacts respective intermediate side panel 44 or 48 to provide support to container 200. In a particular embodiment, portion 110 and/or 112 is angled at about 45° with respect to fold line 100. In alternative embodiments, portion 110 and/or 112 is angled at a suitable angle with respect to fold line 100 to facilitate forming container 200 in a desired shape or configuration.

A third top flap 114 extends from side panel 50 along a fold line 116 and an opposing third bottom flap 118 extends from side panel 50 along a fold line 120. Third top flap 114 includes an outer edge 122 that at least partially defines a perimeter of third top flap 114. Outer edge 122 includes portions 124, 126 that are angled with respect of fold line 116 to correspond to at least a portion of a width parallel with leading edge 36 of intermediate side panel 48 and/or intermediate side panel 50, respectively, with container 200 constructed. In one embodiment, portion 124 and/or 126 contacts respective intermediate side panel 48 or 50 to provide support to container 200. In a particular embodiment, portion 124 and/or 126 is angled at about 45° with respect to fold line 116. In alternative embodiments, portion 124 and/or 126 is angled at a suitable angle with respect to fold line 116 to facilitate forming container 200 in a desired shape or configuration.

A fourth top flap 128 extends from side panel 54 along a fold line 130 and an opposing fourth bottom flap 132 extends from side panel 54 along a fold line 134. Fourth top flap 128 includes an outer edge 136 that at least partially defines a perimeter of fourth top flap 128. Outer edge 136 includes portions 138, 140 that are angled with respect of fold line 130 to correspond to at least a portion of a width parallel with leading edge 36 of intermediate side panel 52 and/or intermediate side panel 56, respectively, with container 200 constructed. In one embodiment, portion 138 and/or 140 contacts respective intermediate side panel 54 or 56 to provide support to container 200. In a particular embodiment, portion 138 and/or 140 is angled at about 45° with respect to fold line 130. In alternative embodiments, portion 138 and/or 140 is angled at a suitable angle with respect to fold line 130 to facilitate forming container 200 in a desired shape or configuration. Similarly, fourth bottom flap 132 includes an outer edge 142 that at least partially defines a perimeter of fourth bottom flap 132. Outer edge 142 includes portions 144, 146 that are angled with respect of fold line 134 to correspond to at least a portion of a width parallel with trailing edge 38 of intermediate side panel 54 and/or intermediate side panel 56, respectively, with container 200 constructed. In one embodiment, portion 144 and/or 146 contacts respective intermediate side panel 54 or 56 to provide support to container 200. In a particular embodiment, portion 144 and/or 146 is angled at about 45° with respect to fold line 134. In alternative embodiments, portion 144 and/or 146 is angled at a suitable angle with respect to fold line 134 to facilitate forming container 200 in a desired shape or configuration.

As will be described in more detail below, the shape, size and arrangement of side panels 42, 46, 50 and 54, as shown in FIG. 1 and described above, facilitate constructing a container having angled side walls, such as shown in FIG. 2. More specifically, the shape, size and arrangement of side panels 42, 46, 50 and 54 facilitate constructing a container having intermediate panels 40/56, 44, 48 and 52 that are obliquely angled with respect to, and interconnect, side panels 42, 46, 50 and 54 of the constructed container.

In one embodiment, container 200 is constructed from blank 30 for packaging a suitable product and/or other formed containers that can be stored and/or displayed. Container 200 is formed from blank 30 by folding blank 30 at the fold lines. In one embodiment, an adhesive material is applied to portions of blank 30 to secure selected portions of container 200 together. In a particular embodiment, container 200 is constructed using a machine.

Figure 3:
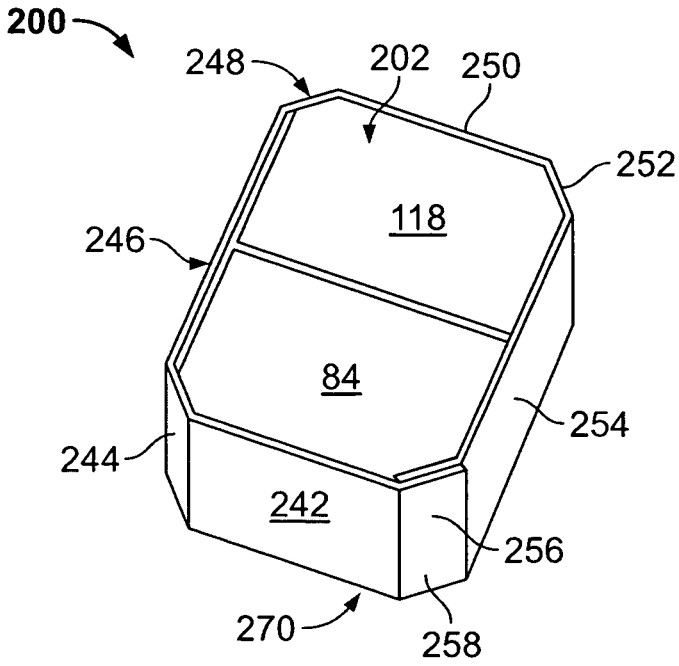
FIG. 3 is a sectional view of the container shown in FIG. 2 along sectional line A-A.

FIG. 2 is an exemplary container 200 constructed or formed from blank 30 shown in FIG. 1 and described in detail above. FIG. 3 is a sectional view of container 200 along section line A-A, shown in FIG. 2. Constructed container 200 defines a cavity 202 within which product can be stored and/or displayed, as shown in FIG. 3. Side panels 42, 46, 50 and 54 form side walls 242, 246, 250 and 254, respectively, of container 200. Intermediate side panel 44 forms intermediate side wall 244 coupling side wall 242 to side wall 246, intermediate side panel 48 forms intermediate side wall 248 coupling side wall 246 to side wall 250, intermediate side panel 52 forms intermediate side wall 252 coupling side wall 250 to side wall 254. Referring to FIGS. 1 and 2, intermediate side panel 40 is coupled to intermediate side panel 56 to form intermediate side wall 256 at a manufacturing joint 258 (shown in FIG. 2). Intermediate side panel 40 is coupled to intermediate side panel 56 at manufacturing joint 258 using a suitable coupler, such as an adhesive material applied to intermediate side panel 40 and/or intermediate side panel 56. In one embodiment, the interior surface of intermediate side panel 40 is coupled to the exterior surface of intermediate side panel 56. In an alternative embodiment, the exterior surface of intermediate side panel 40 is coupled to the interior surface of intermediate side panel 56.

Referring to FIGS. 1 and 2, container 200 also includes a top 260 formed by first top flap 80, second top flap 94, third top flap 114 and fourth top flap 128. In one embodiment, first top flap 80 and third top flap 114 are folded with respect to each other along respective fold lines 82 and 116. More specifically, first top flap 80 and third top flap 114 are orientated generally perpendicular to side wall 242 and side wall 250, respectively. In a particular embodiment, first top flap 80 is coupled to third top flap 114 using a suitable coupler, such as an adhesive material strip or tape (not shown) applied to first top flap 80 and/or third top flap 114. Similarly, second top flap 94 and fourth top flap 128 are folded with respect to each other along respective fold lines 96 and 130 such that second top flap 94 and fourth top flap 128 are orientated generally perpendicular to side wall 246 and side wall 254, respectively. In one embodiment, second top flap 94 is coupled to first top flap 80 and/or third top flap 114 and fourth top flap 128 is coupled to first top flap 80 and/or third top flap 114 using a suitable coupler, such as an adhesive material (not shown) applied to first top flap 80, second top flap 94, third top flap 114 and/or fourth top flap 128. Additionally, or alternatively, second top flap 94 is coupled to fourth top flap 128 using a suitable coupler, such as an adhesive material strip or tape (not shown) applied to second top flap 94 and fourth top flap 128.

Referring to FIGS. 1 and 2, container 200 also includes a bottom 270 formed by first bottom flap 84, second bottom flap 98, third bottom flap 118 and fourth bottom flap 132. In one embodiment, first bottom flap 84 and third bottom flap 118 are folded with respect to each other along respective fold lines 86 and 120. More specifically, first bottom flap 84 and third bottom flap 118 are orientated generally perpendicular to side wall 242 and side wall 250, respectively. In a particular embodiment, first bottom flap 84 is coupled to third bottom flap 118 using a suitable coupler, such as an adhesive material strip or tape (not shown) applied to first bottom flap 84 and/or third bottom flap 118. Similarly, second bottom flap 98 and fourth bottom flap 132 are folded with respect to each other along respective fold lines 100 and 134 such that second bottom flap 98 and fourth bottom flap 132 are orientated generally perpendicular to side wall 246 and side wall 254, respectively. In one embodiment, second bottom flap 98 is coupled to first bottom flap 84 and/or third bottom flap 118 and fourth bottom flap 132 is coupled to first bottom flap 84 and/or third bottom flap 118 using a suitable coupler, such as an adhesive material (not shown) applied to first bottom flap, second bottom flap 98, third bottom flap 118 and/or fourth bottom flap 132. Additionally, or alternatively, second bottom flap 98 is coupled to fourth bottom flap 132 using a suitable coupler, such as an adhesive material strip or tape (not shown) applied to second bottom flap 98 and fourth bottom flap 132.

Accordingly, container 200 has a height 280 measured between an exterior surface of top 260 and an exterior surface of bottom 270, a width 282 measured between an exterior surface of side wall 246 and an exterior surface of side wall 254 and a length 284 measured between an exterior surface of side wall 242 and an exterior surface of side wall 250, as shown in FIG. 2.

Although container 200 may have other orientations without departing from the scope of the present invention, in the embodiment shown in FIG. 2, top 260 is generally parallel with bottom 270, side wall 246 is generally parallel with side wall 254 and side wall 242 is generally parallel with side wall 250. Moreover, side walls 242, 246, 250 and 254 are generally perpendicular to top 260 and bottom 270. Intermediate side walls 244, 248, 252 and 256 form angled walls of container 200. Specifically, intermediate side walls 244, 248, 252 and 256 are obliquely angled with respect to the side walls the intermediate side walls interconnect. As shown in FIGS. 2 and 3, intermediate side wall 244 is obliquely angled with respect to side wall 242 and side wall 246, intermediate side wall 248 is obliquely angled with respect to side wall 246 and side wall 250, intermediate side wall 252 is obliquely angled with respect to side wall 250 and side wall 254 and intermediate side wall 25 is obliquely angled with respect to side wall 254 and side wall 242. In this embodiment, intermediate side walls 244, 248, 252 and 256 are angled at about 45° with respect to the coupled side walls of container 200. In alternative embodiments, top 260 is not generally parallel with bottom 270, side wall 246 is not generally parallel with side wall 254, side wall 242 is not generally parallel with side wall 250 and/or side walls 242, 246, 250 and 254 are not generally perpendicular to top 260 and bottom 270.

In one embodiment, edge portions 92, 104 and/or 110 contact an interior surface of intermediate side wall 244, edge portions 106, 112 and/or 124 contact an interior surface of intermediate side wall 248, edge portions 126, 132 and/or 138 contact an interior surface of intermediate side wall 252 and/or edge portions 90, 140 and/or 146 contact an interior surface of intermediate side wall 256 to provide support to container 200.

Figure 4:
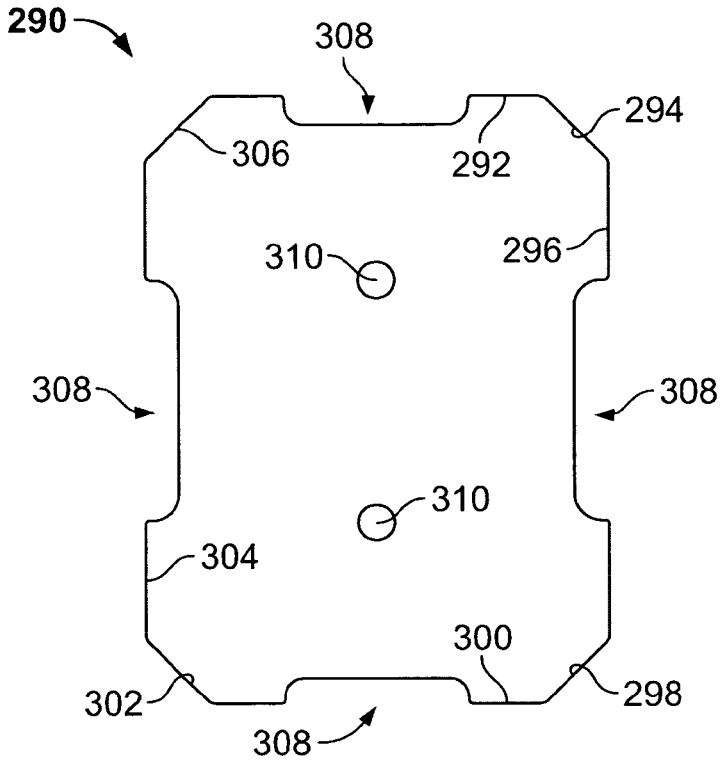
FIG. 4 is a top plan view of an exemplary support panel positionable within the container shown in FIG. 2.

Referring to FIG. 4, in one embodiment, at least one support panel 290 is positionable within cavity 202 defined by container 200 to support container 200 and/or facilitate organizing and/or separating products placed within cavity 202. Support panel 290 includes edge portions 292, 294, 296, 298, 300, 302, 304 and 306. In one embodiment, edge portion 292 is configured to at least partially contact an interior surface of side wall 242, edge portion 296 is configured to at least partially contact an interior surface of side wall 246, edge portion 300 is configured to at least partially contact an interior surface of side wall 250 and edge portion 304 is configured to at least partially contact an interior surface of side wall 254. Additionally, or alternatively, edge portion 294 is configured to at least partially contact an interior surface of intermediate side wall 244, edge portion 298 is configured to at least partially contact an interior surface of intermediate side wall 248, edge portion 302 is configured to at least partially contact an interior surface of intermediate side wall 252 and edge portion 306 is configured to at least partially contact an interior surface of intermediate side wall 256. As shown in FIG. 4, in one embodiment, edge portion 292, 296, 300 and/or 304 defines a cutout portion 308 to facilitate positioning support panel 290 within container 200 and/or removing support panel 290 from within container 200, as desired. In a particular embodiment, support panel 290 forms at least one access hole 310, in addition to or as an alternative to cutout portion 308, to facilitate positioning support panel 290 within container 200 and/or removing support panel 290 from within container 200, as desired.

Figure 6:
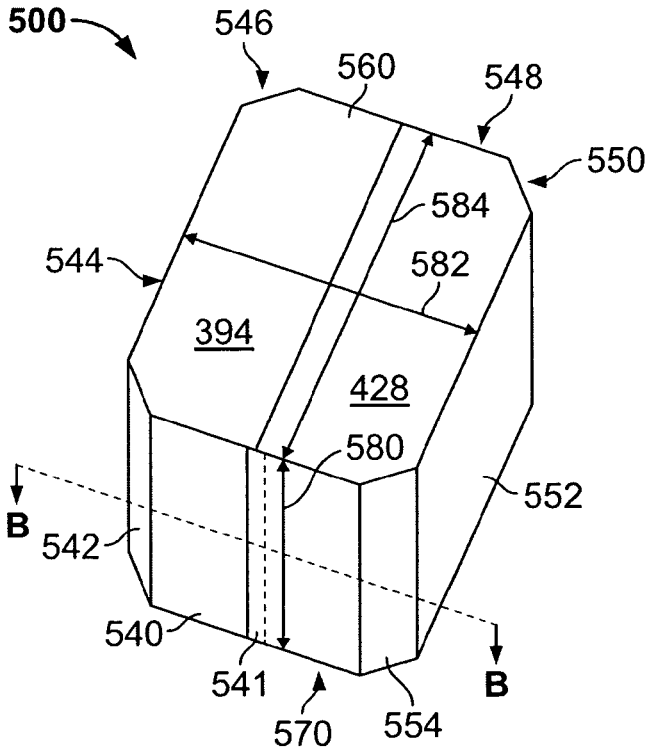
FIG. 6 is a perspective view of a container constructed from the blank shown in FIG. 5.
Figure 5:
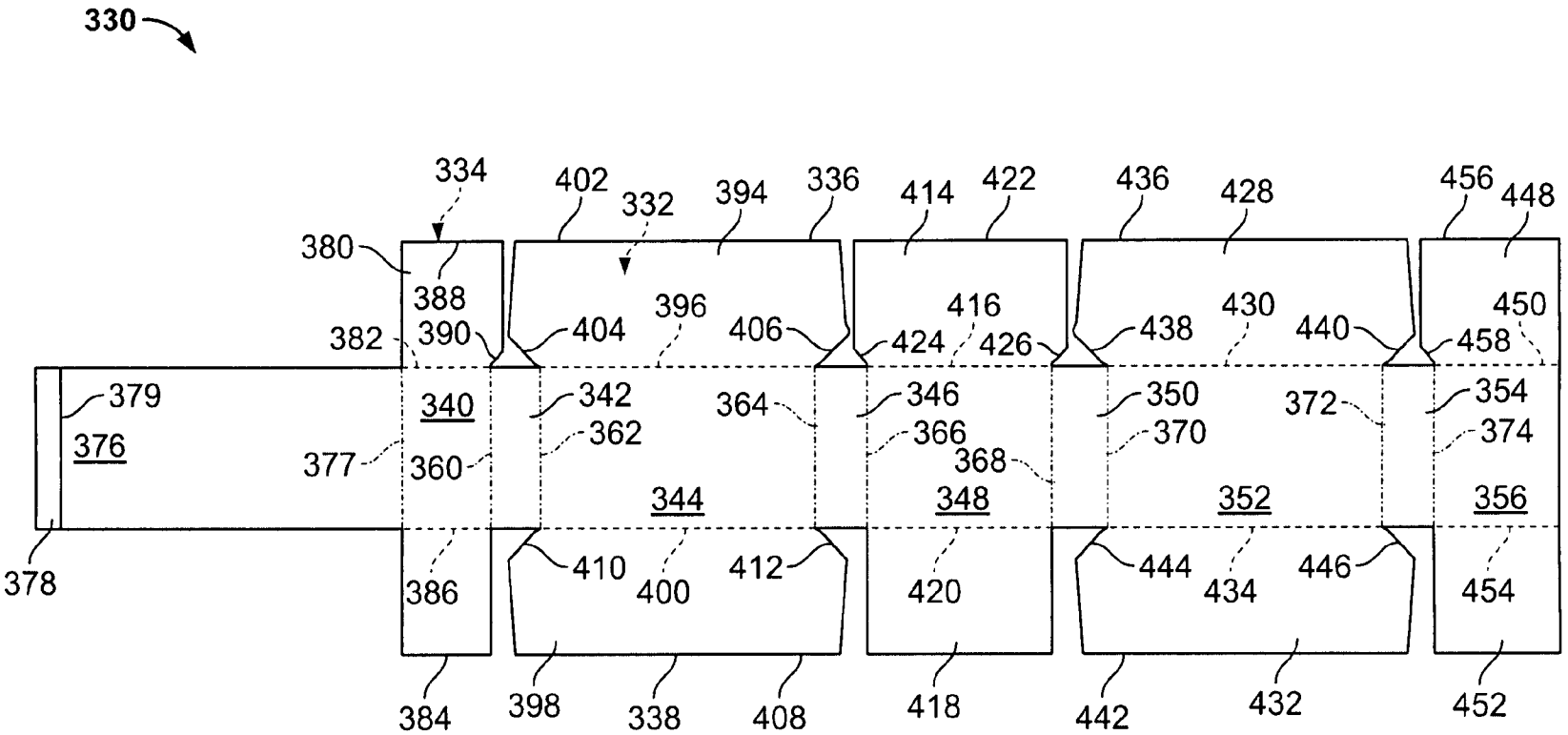
FIG. 5 is a top plan view of an exemplary blank of sheet material.
Figure 7:
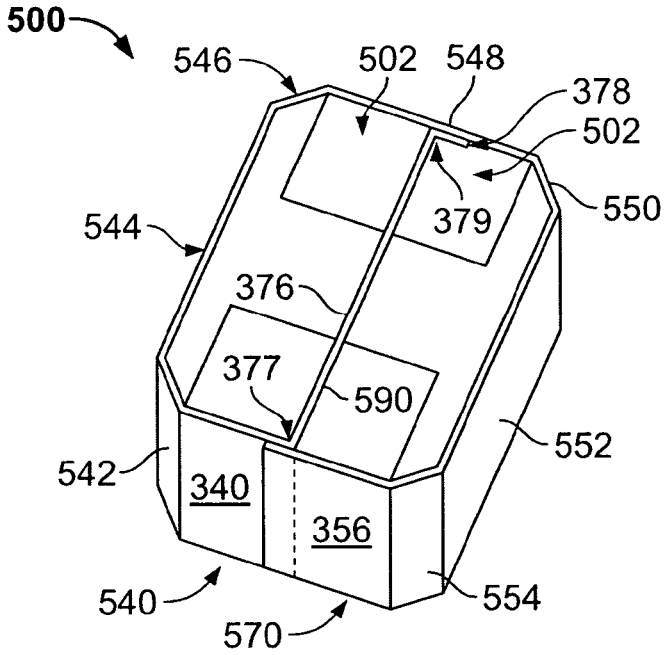
FIG. 7 is a sectional view of the container shown in FIG. 6 along sectional line B-B.

FIGS. 5-7 illustrate the construction or formation of an alternative embodiment of a container. Specifically, FIG. 5 is a top plan view of one embodiment of a blank of sheet material 330. FIG. 6 is a perspective view of one embodiment of a container 500 formed from blank 330 shown in FIG. 5. FIG. 7 is a sectional view of container 500 along section line B-B, shown in FIG. 6.

Referring to FIG. 5, blank 330 has an interior or first surface 332 and an opposing exterior or second surface 334. In one embodiment, first surface 332 is similar or identical to second surface 334 and, thus, first surface 332 and second surface 334 are interchangeable as an exterior surface and an interior surface of blank 330. Further, blank 330 defines a leading edge 336 and an opposing trailing edge 338. In this embodiment, blank 330 has a corrugation direction from leading edge 336 to trailing edge 338. In alternative embodiments, blank 30 has a corrugation direction in any suitable direction. As shown in FIG. 5, blank 330 includes a succession of aligned rectangular side panels 340, 342, 344, 346, 348, 350, 352, 354 and 356 that are coupled together by a plurality of preformed, generally parallel fold lines 360, 362, 364, 366, 368, 370, 372 and 374, respectively. Specifically, the aligned rectangular side panels include side panels 340, 344, 348, 352 and 356, and intermediate side panels 342, 346, 350 and 354. In one embodiment, in constructing container 500 from blank 330, side panels 340 and 356 are coupled together, such as with an adhesive material, at a manufacturing joint to form one side wall of container 500, as described in greater detail below.

Intermediate side panel 342 extends from side panel 340 along fold line 360, side panel 344 extends from intermediate side panel 342 along fold line 362, intermediate side panel 346 extends from side panel 344 along fold line 364, side panel 348 extends from intermediate side panel 346 along fold line 366, intermediate side panel 350 extends from side panel 348 along fold line 368, side panel 352 extends from intermediate side panel 350 along fold line 370, intermediate side panel 354 extend from side panel 352 along fold line 372 and side panel 356 extends from intermediate side panel 354 along fold line 374.

As shown in FIG. 5, a divider panel 376 is coupled to side panel 340 along a fold line 377 generally parallel to fold line 360. A tab 378 is coupled to divider panel 376 along a fold line 379 generally parallel to fold line 377 to facilitate coupling divider panel 376 to an interior surface of side panel 348 with tab 378 during construction of container 500 to form a divider within a cavity defined by container 500, as described in greater detail below.

In one embodiment, each fold line 360, 362, 364, 366, 368, 370, 372, 374, 377 and 379 includes a line of weakening including, without limitation, a score line and/or a perforated score line, suitable for facilitating accurate folding and shaping of blank 330 to construct container 500. It is apparent to those skilled in the art and guided by the teachings herein provided that the fold lines described herein may include any suitable line of weakening.

As shown in FIG. 5, a first top flap 380 extends from side panel 340 along a fold line 382 and an opposing first bottom flap 384 extends from side panel 340 along a fold line 386. First top flap 380 includes an outer edge 388 that at least partially defines a perimeter of first top flap 380. Outer edge 388 includes a portion 390 that is angled with respect of fold line 382 to correspond to at least a portion of a width parallel with leading edge 336 of intermediate side panel 342 with container 500 constructed. In one embodiment, portion 390 contacts intermediate side panel 342 and provides support to container 500. In a particular embodiment, portion 390 is angled at about 45° with respect to fold line 382. In alternative embodiments, portion 390 is angled at a suitable angle with respect to fold line 382 to facilitate forming container 500 in a desired shape or configuration.

A second top flap 394 extends from side panel 344 along a fold line 396 and an opposing second bottom flap 398 extends from side panel 344 along a fold line 400. Second top flap 394 includes an outer edge 402 that at least partially defines a perimeter of second top flap 394. Outer edge 402 includes portions 404, 406 that are angled with respect of fold line 396 to correspond to at least a portion of a width parallel with leading edge 336 of intermediate side panel 342 and/or intermediate side panel 346, respectively, with container 500 constructed. In one embodiment, portion 404 and/or 406 contacts respective intermediate side panel 342 or 346 to provide support to container 500. In a particular embodiment, portion 404 and/or 406 is angled at about 45° with respect to fold line 396. In alternative embodiments, portion 404 and/or 406 is angled at a suitable angle with respect to fold line 396 to facilitate forming container 500 in a desired shape or configuration. Similarly, second bottom flap 398 includes an outer edge 408 that at least partially defines a perimeter of second bottom flap 398. Outer edge 408 includes portions 410, 412 that are angled with respect of fold line 400 to correspond to at least a portion of a width parallel with trailing edge 338 of intermediate side panel 342 and/or intermediate side panel 346, respectively, with container 500 constructed. In one embodiment, portion 410 and/or 412 contacts respective intermediate side panel 342 or 346 to provide support to container 500. In a particular embodiment, portion 410 and/or 412 is angled at about 45° with respect to fold line 400. In alternative embodiments, portion 410 and/or 412 is angled at a suitable angle with respect to fold line 400 to facilitate forming container 500 in a desired shape or configuration.

A third top flap 414 extends from side panel 348 along a fold line 416 and an opposing third bottom flap 418 extends from side panel 348 along a fold line 420. Third top flap 414 includes an outer edge 422 that at least partially defines a perimeter of third top flap 414. Outer edge 422 includes portions 424, 426 that are angled with respect of fold line 416 to correspond to at least a portion of a width parallel with leading edge 336 of intermediate side panel 346 and/or intermediate side panel 350, respectively, with container 500 constructed. In one embodiment, portion 424 and/or 426 contacts respective intermediate side panel 346 or 350 to provide support to container 500. In a particular embodiment, portion 424 and/or 426 is angled at about 45° with respect to fold line 416. In alternative embodiments, portion 424 and/or 426 is angled at a suitable angle with respect to fold line 416 to facilitate forming container 500 in a desired shape or configuration.

A fourth top flap 428 extends from side panel 352 along a fold line 430 and an opposing fourth bottom flap 432 extends from side panel 352 along a fold line 434. Fourth top flap 428 includes an outer edge 436 that at least partially defines a perimeter of fourth top flap 428. Outer edge 436 includes portions 438, 440 that are angled with respect of fold line to correspond to at least a portion of a width parallel with leading edge 336 of intermediate side panel 350 and/or intermediate side panel 354, respectively, with container 500 constructed. In one embodiment, portion 438 and/or 440 contacts respective intermediate side panel 350 or 354 to provide support to container 500. In a particular embodiment, portion 438 and/or 440 is angled at about 45° with respect to fold line 430. In alternative embodiments, portion 438 and/or 440 is angled at a suitable angle with respect to fold line 430 to facilitate forming container 500 in a desired shape or configuration. Similarly, fourth bottom flap 432 includes an outer edge 442 that at least partially defines a perimeter of fourth bottom flap 432. Outer edge 442 includes portions 444, 446 that are angled with respect of fold line 434 to correspond to at least a portion of a width parallel with trailing edge 338 of intermediate side panel 350 and/or intermediate side panel 354, respectively, with container 500 constructed. In one embodiment, portion 444 and/or 446 contacts respective intermediate side panel 350 or 354 to provide support to container 500. In a particular embodiment, portion 444 and/or 446 is angled at about 45° with respect to fold line 434. In alternative embodiments, portion 444 and/or 446 is angled at a suitable angle with respect to fold line 434 to facilitate forming container 500 in a desired shape or configuration.

As shown in FIG. 5, a fifth top flap 448 extends from side panel 356 along a fold line 450 and an opposing fifth bottom flap 452 extends from side panel 356 along a fold line 454. Fifth top flap 448 includes an outer edge 456 that at least partially defines a perimeter of fifth top flap 448. Outer edge 456 includes portion 458 that is angled with respect of fold line 450 to correspond to at least a portion of a width parallel with leading edge 336 of intermediate side panel 354 with container 500 constructed. In one embodiment, portion 458 contacts intermediate side panel 354 and provides support to container 500. In a particular embodiment, portion 458 is angled at about 45° with respect to fold line 450. In alternative embodiments, portion 458 is angled at a suitable angle with respect to fold line 450 to facilitate forming container 500 in a desired shape or configuration.

As will be described in more detail below, the shape, size and arrangement of side panels 340, 344, 348, 352 and 356, as shown in FIG. 5 and described above, facilitate constructing a container having angled walls, such as shown in FIG. 6. More specifically, the shape, size and arrangement of side panels 340, 344, 348, 352 and 356 facilitate constructing a container having intermediate panels 342, 346, 350 and 354 that are obliquely angled with respect to, and interconnect, side panels 340, 344, 348, 352 and 356 of the constructed container.

In one embodiment, container 500 is constructed from blank 330 for packaging a suitable product and/or other formed containers that can be stored and/or displayed. Container 500 is formed from blank 330 by folding blank 330 about the fold lines. In one embodiment, an adhesive material is applied to portions of blank 330 to secure selected portions of container 500 together. In a particular embodiment, container 500 is constructed using a machine.

FIG. 6 is an exemplary container 500 constructed or formed from blank 330 shown in FIG. 5 and described in detail above. FIG. 7 is a sectional view of container 500 along section line B-B, shown in FIG. 6. Constructed container 500 defines a plurality of cavities 502 within which product can be stored and/or displayed, as shown in FIG. 7. Referring to FIGS. 5 and 6, side panel 340 is coupled to side panel 356 to form side wall 540 at a manufacturing joint 541 (shown in FIG. 6). Side panel 340 is coupled to side panel 356 at manufacturing joint 541 using a suitable coupler, such as an adhesive material applied to side panel 340 and/or side panel 356. Side panels 344, 348 and 352 form side walls 544, 548 and 552, respectively, of container 500. Intermediate side panel 342 forms intermediate side wall 542 coupling side wall 540 to side wall 544, intermediate side panel 346 forms intermediate side wall 546 coupling side wall 544 to side wall 548, intermediate side panel 350 forms intermediate side wall 550 coupling side wall 548 to side wall 552 and intermediate side panel 354 forms intermediate side wall 554 coupling side wall 540 to side wall 552.

Referring to FIGS. 5 and 6, container 500 also includes a top 560 formed by first top flap 380, second top flap 394, third top flap 414, fourth top flap 428 and fifth top flap 448. In one embodiment, first top flap 380 and fifth top flap 448 are folded with respect to side wall 540 along respective fold lines 382 and 450. In a particular embodiment, first top flap 380 is coupled to fifth top flap 448 using a suitable coupler, such as an adhesive material. Third top flap 114 is folded with respect to side wall 548 along fold line 416. More specifically, first top flap 380 and fifth top flap 448 are oriented generally perpendicular to side wall 540 and third top flap 114 is orientated generally perpendicular to side wall 548. In one embodiment, first top flap 380 and/or fifth top flap 448 is coupled to third top flap 414 using a suitable coupler, such as an adhesive material strip or tape (not shown) applied to first top flap 380, third top flap 414 and/or fifth top flap 448.

Similarly, second top flap 394 and fourth top flap 428 are folded with respect to each other along respective fold lines 396 and 430 such that second top flap 394 and fourth top flap 428 are orientated generally perpendicular to side wall 544 and side wall 552, respectively. In one embodiment, second top flap 394 is coupled to first top flap 380 and/or third top flap 414 and fourth top flap 428 is coupled to fifth top flap 448 and/or third top flap 414 using a suitable coupler, such as an adhesive material strip or tape (not shown) applied to first top flap 380, second top flap 394, third top flap 414, fourth top flap 428 and/or fifth top flap 448. Additionally, or alternatively, second top flap 394 is coupled to fourth top flap 428 using a suitable coupler, such as an adhesive material tape (not shown) applied to second top flap 394 and fourth top flap 428.

Referring to FIGS. 5 and 6, container 500 also includes a bottom 570 formed by first bottom flap 384, second bottom flap 398, third bottom flap 418, fourth bottom flap 432 and fifth bottom flap 452. In one embodiment, first bottom flap 384 and fifth bottom flap 452 are folded along respective fold lines 386 and 454 with respect to side wall 540. In a particular embodiment, first bottom flap 384 is coupled to fifth bottom flap 452 using a suitable coupler, such as an adhesive material. Third bottom flap 418 is folded along fold line 420 with respect to side wall 548. More specifically, first bottom flap 384 and fifth bottom flap 452 are oriented generally perpendicular to side wall 540 and third bottom flap 418 is orientated generally perpendicular to side wall 548. In a particular embodiment, first bottom flap 384 and/or fifth bottom flap 452 is coupled to third bottom flap 418 using a suitable coupler, such as an adhesive material strip or tape (not shown) applied to first bottom flap 384, third bottom flap 418 and/or fifth bottom flap 452.

Similarly, second bottom flap 398 and fourth bottom flap 432 are folded with respect to each other along respective fold lines 400 and 434 such that second bottom flap 398 and fourth bottom flap 432 are orientated generally perpendicular to side wall 544 and side wall 552, respectively. In one embodiment, second bottom flap 398 is coupled to first bottom flap 384 and/or third bottom flap 418 and fourth bottom flap 432 is coupled to fifth bottom flap 452 and/or third bottom flap 418 using a suitable coupler, such as an adhesive material strip or tape (not shown) applied to first bottom flap 384, second bottom flap 398, third bottom flap 418, fourth bottom flap 432 and/or fifth bottom flap 452. Additionally, or alternatively, second bottom flap 398 is coupled to fourth bottom flap 432 using a suitable coupler, such as an adhesive material strip or tape (not shown) applied to second bottom flap 398 and fourth bottom flap 432.

Accordingly, container 500 has a height 580 measured between an exterior surface of top 560 and an exterior surface of bottom 570, a width 582 measured between an exterior surface of side wall 544 and an exterior surface of side wall 552 and a length 584 measured between an exterior surface of side wall 540 and an exterior surface of side wall 548, as shown in FIG. 6.

Although container 500 may have other orientations without departing from the scope of the present invention, in the embodiment shown in FIG. 6, top 560 is generally parallel with bottom 570, side wall 544 is generally parallel with side wall 552 and side wall 540 is generally parallel with side wall 548. Moreover, side walls 540, 544, 548 and 552 are generally perpendicular to top 560 and bottom 570. Intermediate side walls 542, 546, 550 and 554 form angled walls of container 500. Specifically, intermediate side walls 542, 546, 550 and 554 are obliquely angled with respect to the side walls the intermediate side walls interconnect. As shown in FIGS. 6 and 7, intermediate side wall 542 is obliquely angled with respect to side wall 540 and side wall 544, intermediate side wall 546 is obliquely angled with respect to side wall 544 and side wall 548, intermediate side wall 550 is obliquely angled with respect to side wall 548 and side wall 552 and intermediate side wall 554 is obliquely angled with respect to side wall 552 and side wall 540. In this embodiment, intermediate side walls 542, 546, 550 and 554 are angled at about 45° with respect to the coupled side walls of container 500. In alternative embodiments, top 560 is not generally parallel with bottom 570, side wall 544 is not generally parallel with side wall 552, side wall 540 is not generally parallel with side wall 548 and/or side walls 540, 544, 548 and 552 are not generally perpendicular to top 560 and bottom 570.

As shown in FIG. 7, during construction of container 500, divider panel 376 extends between side wall 540 and side wall 548 to form a divider 590 to facilitate compartmentalizing cavity 502. More specifically, divider panel 376 is folded with respect to side panel 340 along fold line 377 and oriented generally perpendicular to side panel 340. Tab 378 is folded with respect to divider panel 376 along fold line 379 to couple divider panel 376 to an interior surface of side panel 548 during construction of container 500 to form divider 590 within cavity 502. In an alternative embodiment, divider panel 376 is folded with respect to side panel 340 along fold line 377 and oriented at angle such that divider panel 376 is not generally perpendicular to side panel 340.

In one embodiment, edge portions 390, 404 and/or 410 contact an interior surface of intermediate side wall 542, edge portions 406, 412 and/or 424 contact an interior surface of intermediate side wall 546, edge portions 426, 438 and/or 444 contact an interior surface of intermediate side wall 550 and/or edge portions 440, 446 and/or 458 contact an interior surface of intermediate side wall 554 to provide support to container 500.

Figure 9:
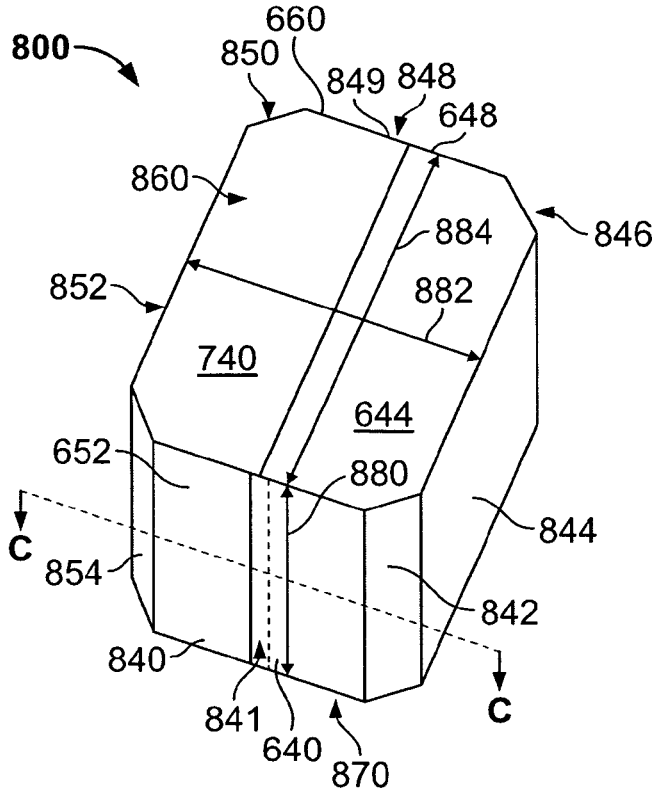
FIG. 9 is a perspective view of a container constructed from the blank shown in FIG. 8.
Figure 8:
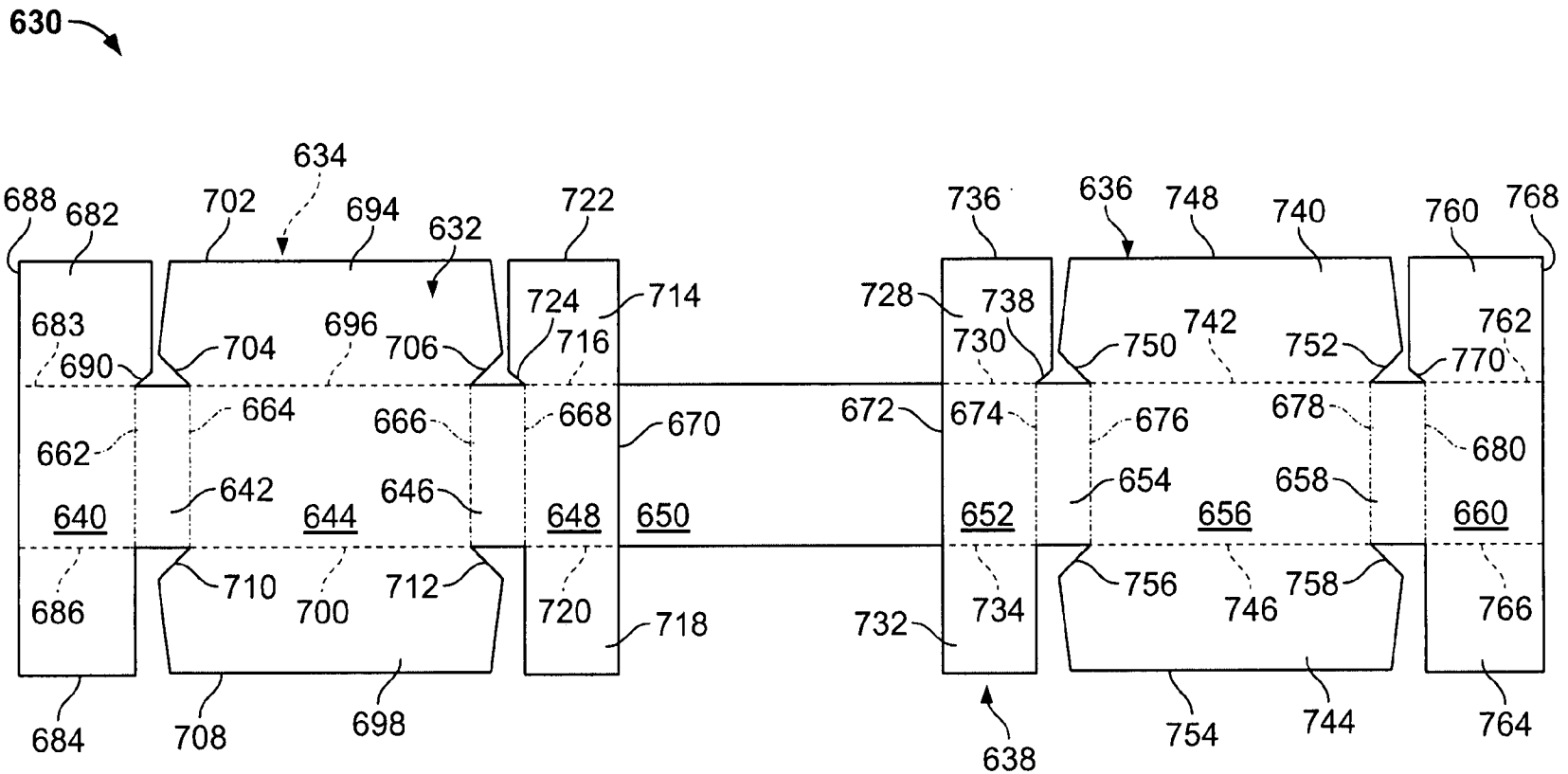
FIG. 8 is a top plan view of an exemplary blank of sheet material.
Figure 10:
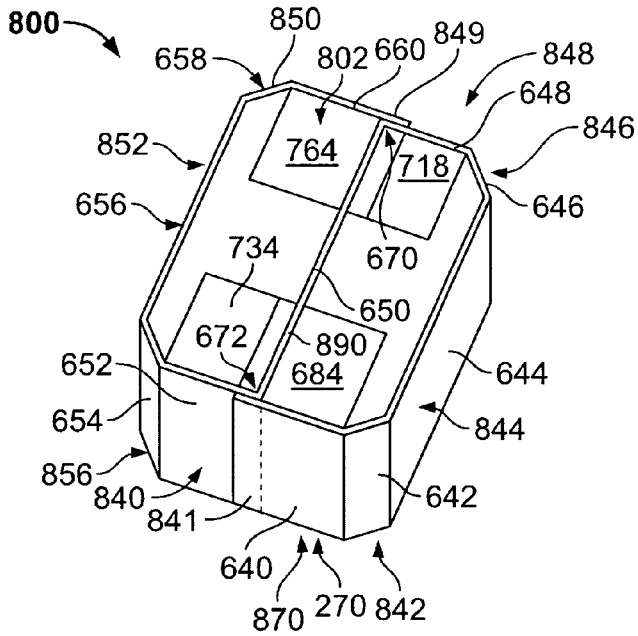
FIG. 10 is a sectional view of the container shown in FIG. 9 along sectional line C-C.

FIGS. 8-10 illustrate the construction or formation of an alternative embodiment of a container. Specifically, FIG. 8 is a top plan view of one embodiment of a blank of sheet material 630. FIG. 9 is a perspective view of one embodiment of a container 800 formed from blank 630 shown in FIG. 8. FIG. 10 is a sectional view of container 800 along section line C-C, shown in FIG. 9.

Referring to FIG. 8, blank 630 has an interior or first surface 632 and an opposing exterior or second surface 634. In one embodiment, first surface 632 is similar or identical to second surface 634 and, thus, first surface 632 and second surface 634 are interchangeable as an exterior surface and an interior surface of blank 630. Further, blank 630 defines a leading edge 636 and an opposing trailing edge 638. In this embodiment, blank 630 has a corrugation direction from leading edge 636 to trailing edge 638. In alternative embodiments, blank 30 has a corrugation direction in any suitable direction. As shown in FIG. 8, blank 630 includes a succession of aligned rectangular panels 640, 642, 644, 646, 648, 650, 652, 654, 656, 658 and 660 that are coupled together by a plurality of preformed, generally parallel fold lines 662, 664, 666, 668, 670, 672, 674, 676, 678 and 680, respectively. Specifically, the aligned rectangular panels include side panels 640, 644, 648, 652, 656 and 660, intermediate side panels 642, 646, 654 and 658, and a divider panel 650. In one embodiment, in constructing container 800 from blank 630, side panels 640 and 652 are coupled together, such as with an adhesive material, at a first manufacturing joint to form a side wall of container 800, and side panels 648 and 660 are coupled together at a second manufacturing joint to form an opposing side wall of container 800, as described in greater detail below.

Intermediate side panel 642 extends from side panel 640 along fold line 662, side panel 644 extends from intermediate side panel 642 along fold line 664, intermediate side panel 646 extends from side panel 644 along fold line 666, side panel 648 extends from intermediate side panel 646 along fold line 668, divider panel 650 extends from side panel 648 along fold line 670, side panel 652 extends from divider panel 650 along fold line 672, intermediate side panel 654 extends from side panel 652 along fold line 674, side panel 656 extends from intermediate side panel 654 along fold line 676, intermediate side panel 658 extends from side panel 656 along fold line 678, and side panel 660 extends from intermediate side panel 658 along fold line 680.

In one embodiment, each fold line 662, 664, 646, 666, 668, 670, 672, 674, 676, 678, and 680 includes a line of weakening including, without limitation, a score line and/or a perforated score line, suitable for facilitating accurate folding and shaping of blank 630 to construct container 800. It is apparent to those skilled in the art and guided by the teachings herein provided that the fold lines described herein may include any suitable line of weakening.

As shown in FIG. 8, a first top flap 682 extends from side panel 640 along a fold line 683 and an opposing first bottom flap 684 extends from side panel 640 along a fold line 686. First top flap 682 includes an outer edge 688 that at least partially defines a perimeter of first top flap 680. Outer edge 688 includes a portion 690 that is angled with respect of fold line 683 to correspond to at least a portion of a width parallel with leading edge 636 of intermediate side panel 642 with container 800 constructed. In one embodiment, portion 690 contacts intermediate side panel 642 and provides support to container 800. In a particular embodiment, portion 690 is angled at about 45° with respect to fold line 683. In alternative embodiments, portion 690 is angled at a suitable angle with respect to fold line 683 to facilitate forming container 800 in a desired shape or configuration.

A second top flap 694 extends from side panel 644 along a fold line 696 and an opposing second bottom flap 698 extends from side panel 644 along a fold line 700. Second top flap 694 includes an outer edge 702 that at least partially defines a perimeter of second top flap 694. Outer edge 702 includes portions 704, 706 that are angled with respect of fold line 696 to correspond to at least a portion of a width parallel with leading edge 636 of intermediate side panel 642 and/or intermediate side panel 646, respectively, with container 800 constructed. In one embodiment, portion 704 and/or 706 contacts respective intermediate side panel 642 or 646 to provide support to container 800. In a particular embodiment, portion 704 and/or 706 is angled at about 45° with respect to fold line 696. In alternative embodiments, portion 704 and/or 706 is angled at a suitable angle with respect to fold line 696 to facilitate forming container 800 in a desired shape or configuration. Similarly, second bottom flap 698 includes an outer edge 708 that at least partially defines a perimeter of second bottom flap 698. Outer edge 708 includes portions 710, 712 that are angled with respect of fold line 700 to correspond to at least a portion of a width parallel with trailing edge 638 of intermediate side panel 642 and/or intermediate side panel 646, respectively, with container 800 constructed. In one embodiment, portion 710 and/or 712 contacts respective intermediate side panel 642 or 646 to provide support to container 800. In a particular embodiment, portion 710 and/or 712 is angled at about 45° with respect to fold line 700. In alternative embodiments, portion 710 and/or 712 is angled at a suitable angle with respect to fold line 700 to facilitate forming container 800 in a desired shape or configuration.

A third top flap 714 extends from side panel 648 along a fold line 716 and an opposing third bottom flap 718 extends from side panel 648 along a fold line 720. Third top flap 714 includes an outer edge 722 that at least partially defines a perimeter of third top flap 714. Outer edge 722 includes portion 724 angled with respect of fold line 716 to correspond to at least a portion of a width parallel with leading edge 636 of intermediate side panel 646 with container 800 constructed. In one embodiment, portion 724 contacts intermediate side panel 646 to provide support to container 800. In a particular embodiment, portion 624 is angled at about 45° with respect to fold line 716. In alternative embodiments, portion 624 is angled at a suitable angle with respect to fold line 716 to facilitate forming container 800 in a desired shape or configuration.

A fourth top flap 728 extends from side panel 652 along a fold line 730 and an opposing fourth bottom flap 732 extends from side panel 652 along a fold line 734. Fourth top flap 428 includes an outer edge 736 that at least partially defines a perimeter of fourth top flap 728. Outer edge 736 includes portion 738 that are angled with respect of fold line to correspond to at least a portion of a width parallel with leading edge 636 of intermediate side panel 654 with container 800 constructed. In one embodiment, portion 738 contacts respective intermediate side panel 654 to provide support to container 800. In a particular embodiment, portion 738 is angled at about 45° with respect to fold line 730. In alternative embodiments, portion 738 is angled at a suitable angle with respect to fold line 730 to facilitate forming container 800 in a desired shape or configuration.

A fifth top flap 740 extends from side panel 656 along a fold line 742 and an opposing fifth bottom flap 744 extends from side panel 656 along a fold line 746. Fifth top flap 740 includes an outer edge 748 that at least partially defines a perimeter of fifth top flap 740. Outer edge 748 includes portions 750, 752 that are angled with respect of fold line 742 to correspond to at least a portion of a width parallel with leading edge 636 of intermediate side panel 654 and/or intermediate side panel 658, respectively, with container 800 constructed. In one embodiment, portion 750 and/or 752 contacts respective intermediate side panel 654 or 658 to provide support to container 800. In a particular embodiment, portion 750 and/or 752 is angled at about 45° with respect to fold line 742. In alternative embodiments, portion 750 and/or 752 is angled at a suitable angle with respect to fold line 742 to facilitate forming container 800 in a desired shape or configuration. Similarly, fifth bottom flap 744 includes an outer edge 754 that at least partially defines a perimeter of fifth bottom flap 744. Outer edge 754 includes portions 756, 758 that are angled with respect of fold line 746 to correspond to at least a portion of a width parallel with trailing edge 638 of intermediate side panel 654 and/or intermediate side panel 658, respectively, with container 800 constructed. In one embodiment, portion 756 and/or 758 contacts respective intermediate side panel 654 or 658 to provide support to container 800. In a particular embodiment, portion 756 and/or 758 is angled at about 45° with respect to fold line 746. In alternative embodiments, portion 756 and/or 758 is angled at a suitable angle with respect to fold line 746 to facilitate forming container 800 in a desired shape or configuration.

As shown in FIG. 8, a sixth top flap 760 extends from side panel 660 along a fold line 762 and an opposing sixth bottom flap 764 extends from side panel 660 along a fold line 766. Sixth top flap 760 includes an outer edge 768 that at least partially defines a perimeter of sixth top flap 760. Outer edge 768 includes portion 770 that is angled with respect of fold line 762 to correspond to at least a portion of a width parallel with leading edge 636 of intermediate side panel 658 with container 800 constructed. In one embodiment, portion 770 contacts intermediate side panel 658 and provides support to container 800. In a particular embodiment, portion 770 is angled at about 45° with respect to fold line 762. In alternative embodiments, portion 770 is angled at a suitable angle with respect to fold line 762 to facilitate forming container 800 in a desired shape or configuration.

As will be described in more detail below, the shape, size and arrangement of side panels 640, 644, 648, 652, 656 and 660, as shown in FIG. 8 and described above, facilitate constructing a container having angled walls, such as shown in FIG. 9. More specifically, the shape, size and arrangement of side panels 640, 644, 648, 652, 656 and 660 facilitate constructing a container having intermediate panels 642, 646, 654 and 658 that are obliquely angled with respect to, and interconnect, side panels 640, 644, 648, 652, 656 and 660 of the constructed container.

In one embodiment, container 800 is constructed from blank 630 for packaging a suitable product and/or other formed containers that can be stored and/or displayed. Container 800 is formed from blank 630 by folding blank 630 about the fold lines. In one embodiment, an adhesive material is applied to portions of blank 630 to secure selected portions of container 800 together. In a particular embodiment, container 800 is constructed using a machine.

FIG. 9 is an exemplary container 800 constructed or formed from blank 630 shown in FIG. 8 and described in detail above. FIG. 10 is a sectional view of container 800 along section line C-C, shown in FIG. 9. Constructed container 800 defines a cavity 802 within which product can be stored and/or displayed, as shown in FIG. 10. Referring to FIGS. 8-10, side panel 640 is coupled to side panel 652 to form side wall 840 at a manufacturing joint 841 (shown in FIGS. 9 and 10), side panel 644 forms side wall 844, side panel 648 is coupled to side panel 660 to form 848 at manufacturing joint 849 (shown in FIGS. 9 and 10), and side panel 656 forms side wall 852, respectively, of container 800. Intermediate side panel 642 forms intermediate side wall 842 coupling side wall 840 to side wall 844, intermediate side panel 646 forms intermediate side wall 846 coupling side wall 844 to side wall 848, intermediate side panel 658 forms intermediate side wall 850 coupling side wall 848 to side wall 852 and intermediate side panel 654 forms intermediate side wall 854 coupling side wall 852 to side wall 840.

Referring to FIGS. 8 and 9, container 800 also includes a top 860 formed by first top flap 682, second top flap 694, third top flap 714, fourth top flap 728, fifth top flap 740 and sixth top flap 760. In one embodiment, first top flap 682 and fourth top flap 728 are folded with respect to side wall 840 along respective fold lines 683 and 730. In a particular embodiment, first top flap 682 is coupled to fourth top flap 728 using a suitable coupler, such as an adhesive material. Similarly, third top flap 714 and sixth top flap 760 are folded with respect to side wall 848 along respective fold lines 716 and 762. In a particular embodiment, third top flap 714 is coupled to sixth top flap 760 using a suitable coupler, such as an adhesive material. More specifically, first top flap 682 and fourth top flap 728 are oriented generally perpendicular to side wall 840 and third top flap 714 and sixth top flap 760 are orientated generally perpendicular to side wall 848. In one embodiment, first top flap 682 and/or fourth top flap 728 are coupled to third top flap 714 and/or sixth top flap 760 using a suitable coupler, such as an adhesive material strip (not shown) applied to first top flap 682, third top flap 714, fourth top flap 728 and/or sixth top flap 760.

Second top flap 694 and fifth top flap 740 are folded with respect to each other along respective fold lines 696 and 742 such that second top flap 694 and fifth top flap 740 are orientated generally perpendicular to side wall 844 and side wall 852, respectively. In one embodiment, second top flap 694 is coupled to first top flap 682 and/or third top flap 714 and fifth top flap 740 is coupled to fourth top flap 728 and/or sixth top flap 760 using a suitable coupler, such as an adhesive material strip (not shown) applied to first top flap 682, second top flap 694, third top flap 714, fourth top flap 728, fifth top flap 740 and/or sixth top flap 760. Additionally, or alternatively, second top flap 694 is coupled to fifth top flap 740 using a suitable coupler, such as an adhesive material tape (not shown) applied to second top flap 694 and fifth top flap 740.

Referring to FIGS. 8 and 9, container 800 also includes a bottom 870 formed by first bottom flap 684, second bottom flap 698, third bottom flap 718, fourth bottom flap 732, fifth bottom flap 744 and sixth bottom flap 764. In one embodiment, first bottom flap 684 and fourth bottom flap 732 are folded along respective fold lines 686 and 734 with respect to side wall 840. In a particular embodiment, first bottom flap 684 is coupled to fourth bottom flap 732 using a suitable coupler, such as an adhesive material. Third bottom flap 718 and sixth bottom flap 764 are folded along respective fold lines 720 and 766 with respect to side wall 848. In a particular embodiment, third bottom flap 718 is coupled to sixth bottom flap 764 using a suitable coupler, such as an adhesive material. More specifically, first bottom flap 684 and fourth bottom flap 732 are oriented generally perpendicular to side wall 840 and third bottom flap 718 and sixth bottom flap 764 are orientated generally perpendicular to side wall 848. In a particular embodiment, first bottom flap 684 and/or fourth bottom flap 732 are coupled to third bottom flap 718 and/or sixth bottom flap 764 using a suitable coupler, such as an adhesive material strip (not shown) applied to first bottom flap 684, third bottom flap 718, fourth bottom flap 732 and/or sixth bottom flap 764.

Second bottom flap 698 and fifth bottom flap 744 are folded with respect to each other along respective fold lines 700 and 746 such that second bottom flap 698 and fifth bottom flap 744 are orientated generally perpendicular to side wall 844 and side wall 852, respectively. In one embodiment, second bottom flap 698 is coupled to first bottom flap 684 and/or third bottom flap 718 and fifth bottom flap 744 is coupled to fourth bottom flap 732 and/or sixth bottom flap 764 using a suitable coupler, such as an adhesive material strip (not shown) applied to first bottom flap 684, second bottom flap 698, third bottom flap 718, fourth bottom flap 732, fifth bottom flap 744 and/or sixth bottom flap 764. Additionally, or alternatively, second bottom flap 698 is coupled to fourth bottom flap 732 using a suitable coupler, such as an adhesive material tape (not shown) applied to second bottom flap 698 and fourth bottom flap 732.

Accordingly, container 800 has a height 880 measured between an exterior surface of top 860 and an exterior surface of bottom 870, a width 882 measured between an exterior surface of side wall 844 and an exterior surface of side wall 852 and a length 884 measured between an exterior surface of side wall 840 and an exterior surface of side wall 848, as shown in FIG. 9.

Although container 800 may have other orientations without departing from the scope of the present invention, in the embodiment shown in FIG. 9, top 860 is generally parallel with bottom 870, side wall 844 is generally parallel with side wall 852 and side wall 840 is generally parallel with side wall 848. Moreover, side walls 840, 844, 848 and 852 are generally perpendicular to top 860 and bottom 870. Intermediate side walls 842, 846, 850 and 854 form angled walls of container 800. Specifically, intermediate side walls 842, 946, 850 and 854 are obliquely angled with respect to the side walls the intermediate side walls interconnect. As shown in FIGS. 9 and 10, intermediate side wall 842 is obliquely angled with respect to side wall 840 and side wall 844, intermediate side wall 846 is obliquely angled with respect to side wall 844 and side wall 848, intermediate side wall 850 is obliquely angled with respect to side wall 848 and side wall 852 and intermediate side wall 854 is obliquely angled with respect to side wall 852 and side wall 840. In this embodiment, intermediate side walls 842, 846, 850 and 854 are angled at about 45° with respect to the coupled side walls of container 800. In alternative embodiments, top 860 is not generally parallel with bottom 870, side wall 844 is not generally parallel with side wall 852, side wall 840 is not generally parallel with side wall 848 and/or side walls 840, 844, 848 and 852 are not generally perpendicular to top 860 and bottom 870.

As shown in FIG. 10, during construction of container 800, divider panel 650 extends between side wall 840 and side wall 848 to form a divider 890 to facilitate compartmentalizing cavity 802. More specifically, divider panel 650 is folded at a first end portion with respect to side panel 648 along fold line 670 and oriented generally perpendicular to side panel 648. Divider panel 650 is also folded at an opposing second end portion with respect to side panel 652 along fold line 672 and oriented generally perpendicular to side panel 652 to form divider 890 within cavity 802. In this embodiment, divider panel 650 of blank 630 is folded as described herein to form divider 890 of container 800.

As shown in FIG. 8, in one embodiment, edge portions 690, 704 and/or 710 contact an interior surface of intermediate side 642, edge portions 706, 712 and/or 724 contact an interior surface of intermediate side 646, edge portions 738, 750 and/or 756 contact an interior surface of intermediate side 654 and/or edge portions 752, 758 and/or 770 contact an interior surface of intermediate side 658 to provide support to container 800.

Figure 11:
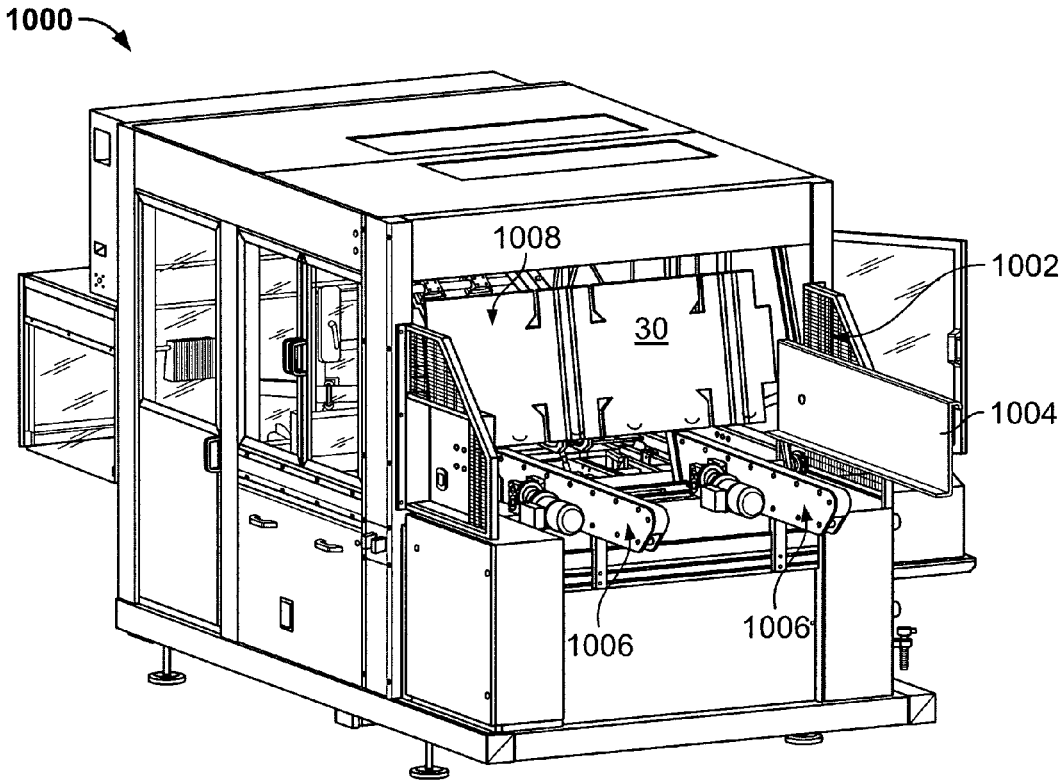
FIG. 11 is a perspective view of an exemplary machine that may be used to form a container from the blank of sheet material shown in FIG. 1, 5 or 8.

FIG. 11 illustrates a machine 1000 for constructing or forming a container, such as container 200, 500 or 800, as shown in FIG. 2, 6 and 9, respectively, from a blank of sheet material 30, 330 or 630, as shown in FIGS. 1, 5 and 8, respectively. It is apparent to those skilled in the art and guided by the teachings herein provided that machine 1000 may be used to construct a container having any suitable size, shape and/or configuration from a blank having a corresponding size, shape and/or configuration without departing from the scope of the present invention.

Figure 12:
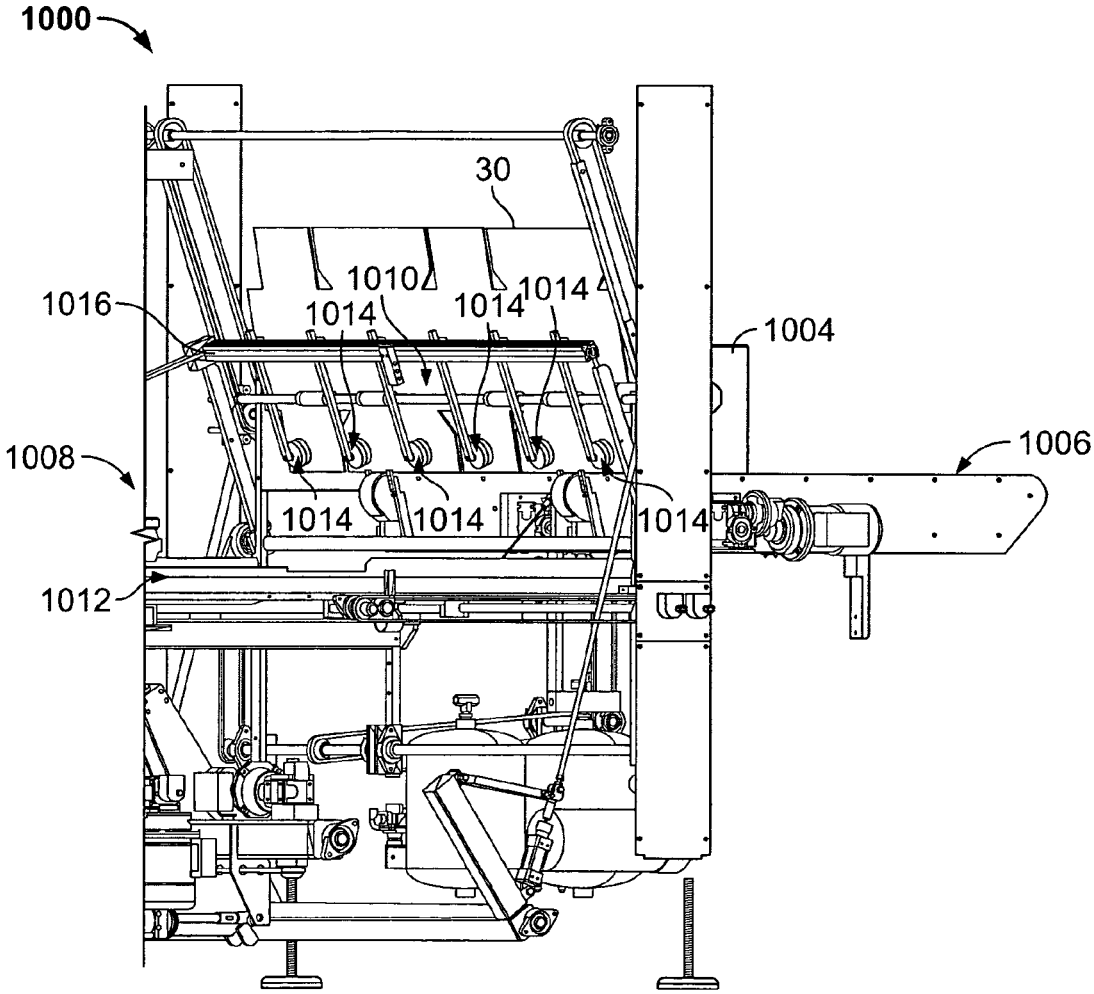
FIG. 12 is a perspective view of a portion of the machine shown in FIG. 11.
Figure 13:
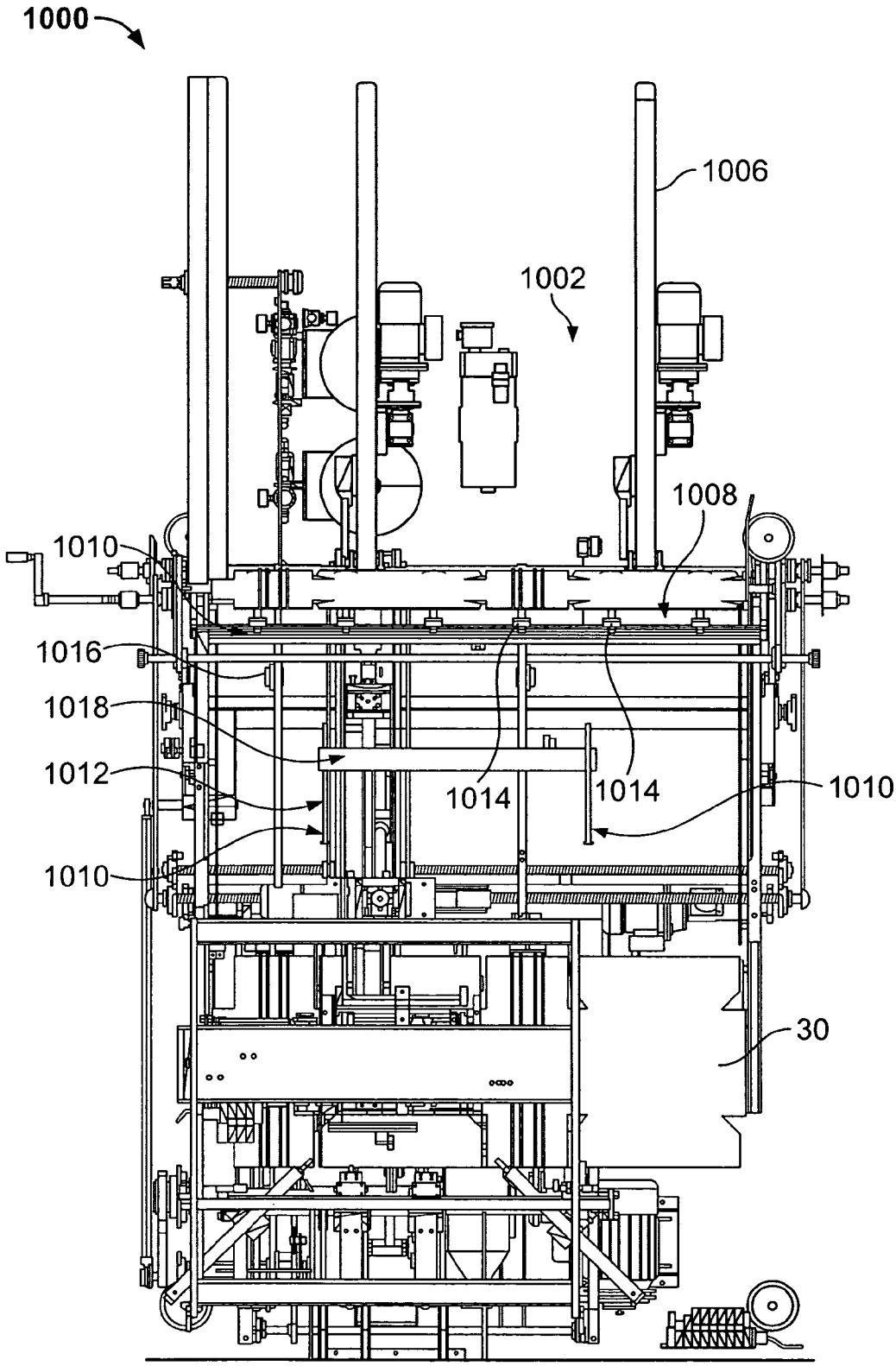
FIG. 13 is a top plan view of the machine shown in FIG. 11.

Machine 1000 includes a loading section 1002 for loading at least one blank into machine 1000 for construction into containers. In one embodiment, one or more blanks 30 are loaded into a loading frame 1004 that supports the one or more blanks 30 in a generally vertical position. A conveyor 1006, which is located on a side, top or bottom of machine 1000, moves blank 30 into a transfer section 1008 as loading frame 1004 supports blank 30. As shown in FIGS. 12 and 13, a gripping member 1010 attaches to blank 30 and lifts blank 30 out of loading frame 1004 and places blank 30 onto a support 1012 in a generally horizontal position. In a particular embodiment, gripping member 1010 includes a plurality of vacuum cups 1014 connected to a rotating frame 1015. Vacuum cups 1014 attach to blank 30 and grip blank 30 as rotating frame 1015 positions blank 30 over support 1012 in front of a pusher assembly 1018, as shown in FIG. 13. Vacuum cups 1014 then release blank 30 onto support 1012. It is apparent to those skilled in the art and guided by the teachings herein provided that any suitable gripping mechanism and/or structure may be used to attach lift blank 30 out of loading frame 1004 and onto support 1012.

In alternative embodiments, loading section 1002 loads blank 30 into loading frame 1004 in any suitable orientation with respect to support 1012. Further, blank 30 may be fed from a top or a bottom of a magazine of blanks 30 in one or more suitable directions, such as a lateral or forward direction with respect to support 1012. It is apparent to those skilled in the art and guided by the teachings herein provided that blanks 30 can be loaded into machine 1000 and/or supported by machine 1000 in any suitable orientation and/or configuration.

Figure 14:
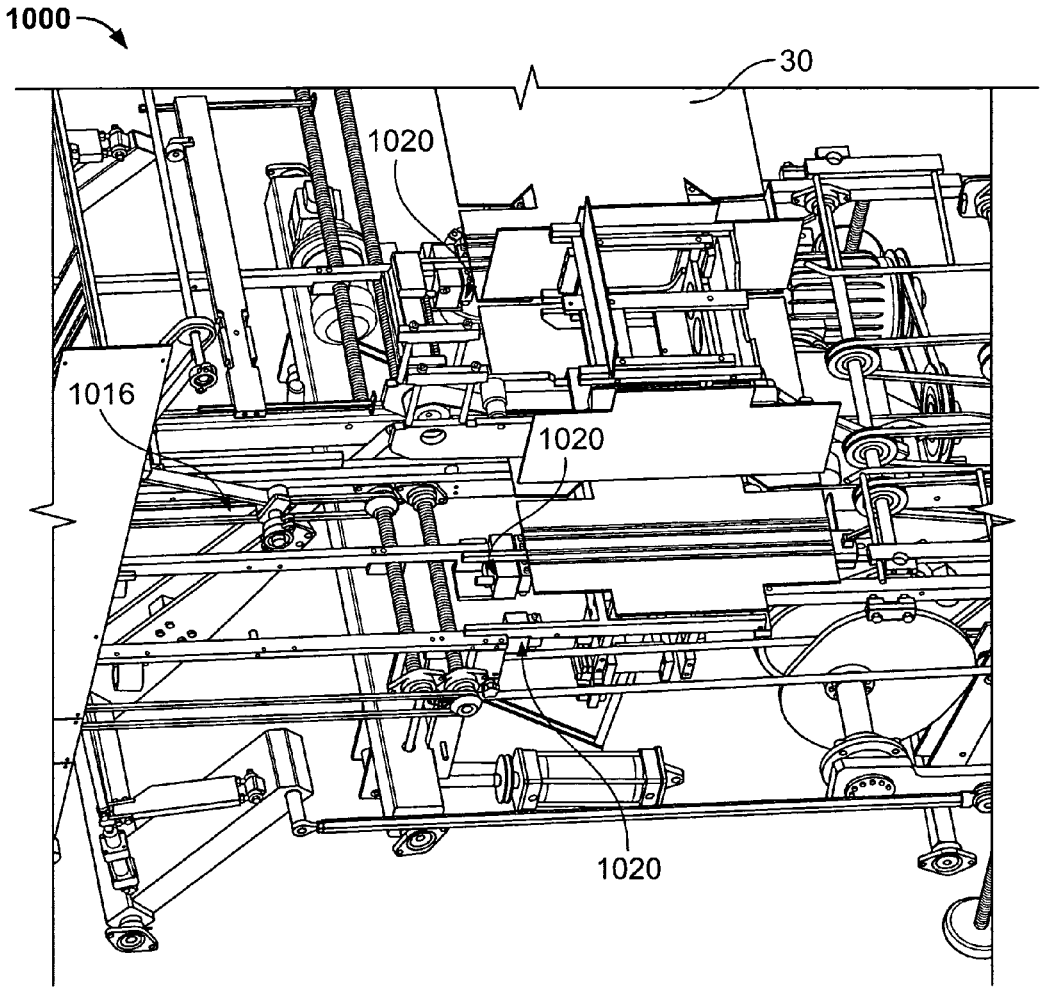
FIG. 14 is a perspective view of a portion of the machine shown in FIG. 11.
Figure 15:
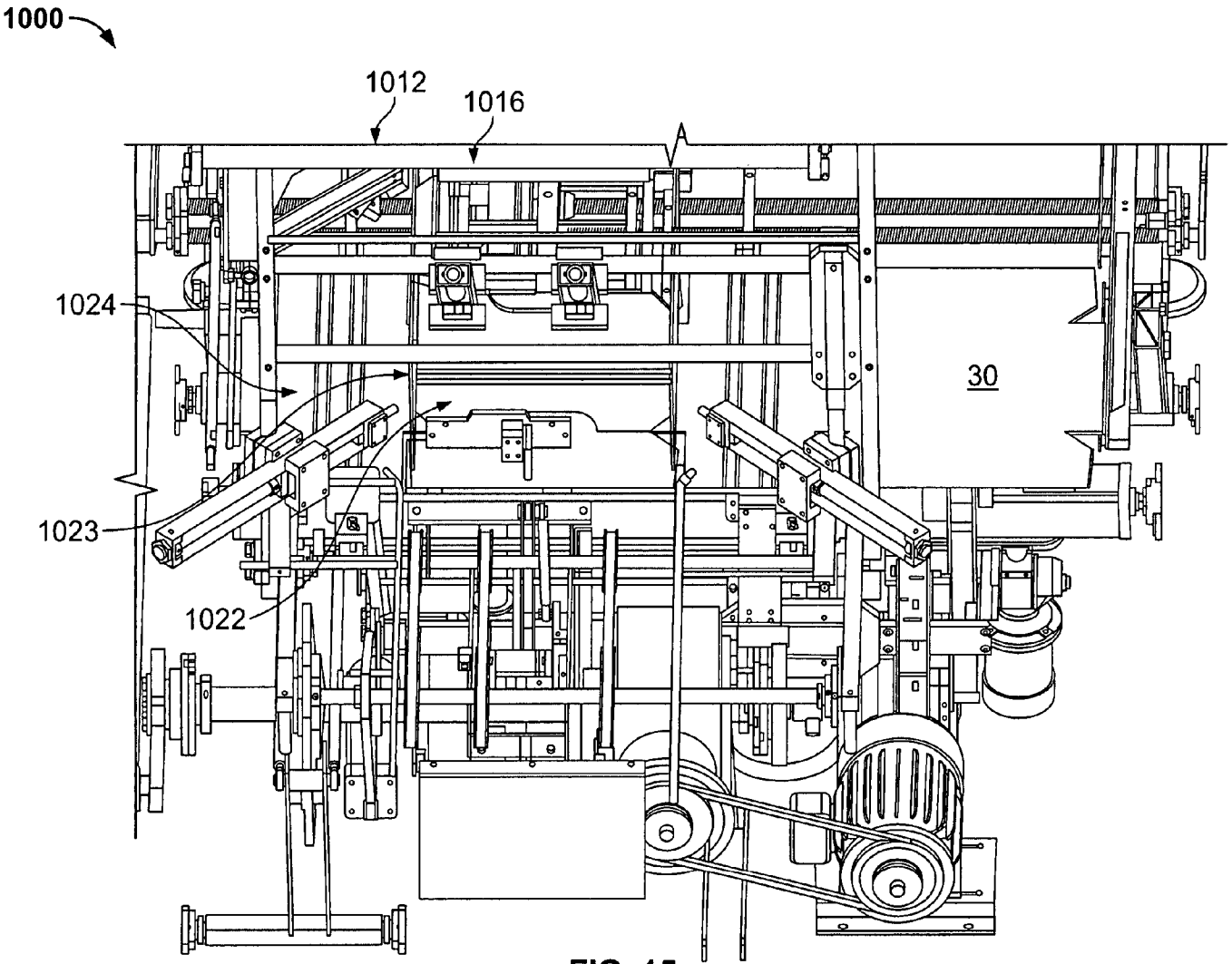
FIG. 15 is a perspective view of a portion of the machine shown in FIG. 11.
Figure 16:
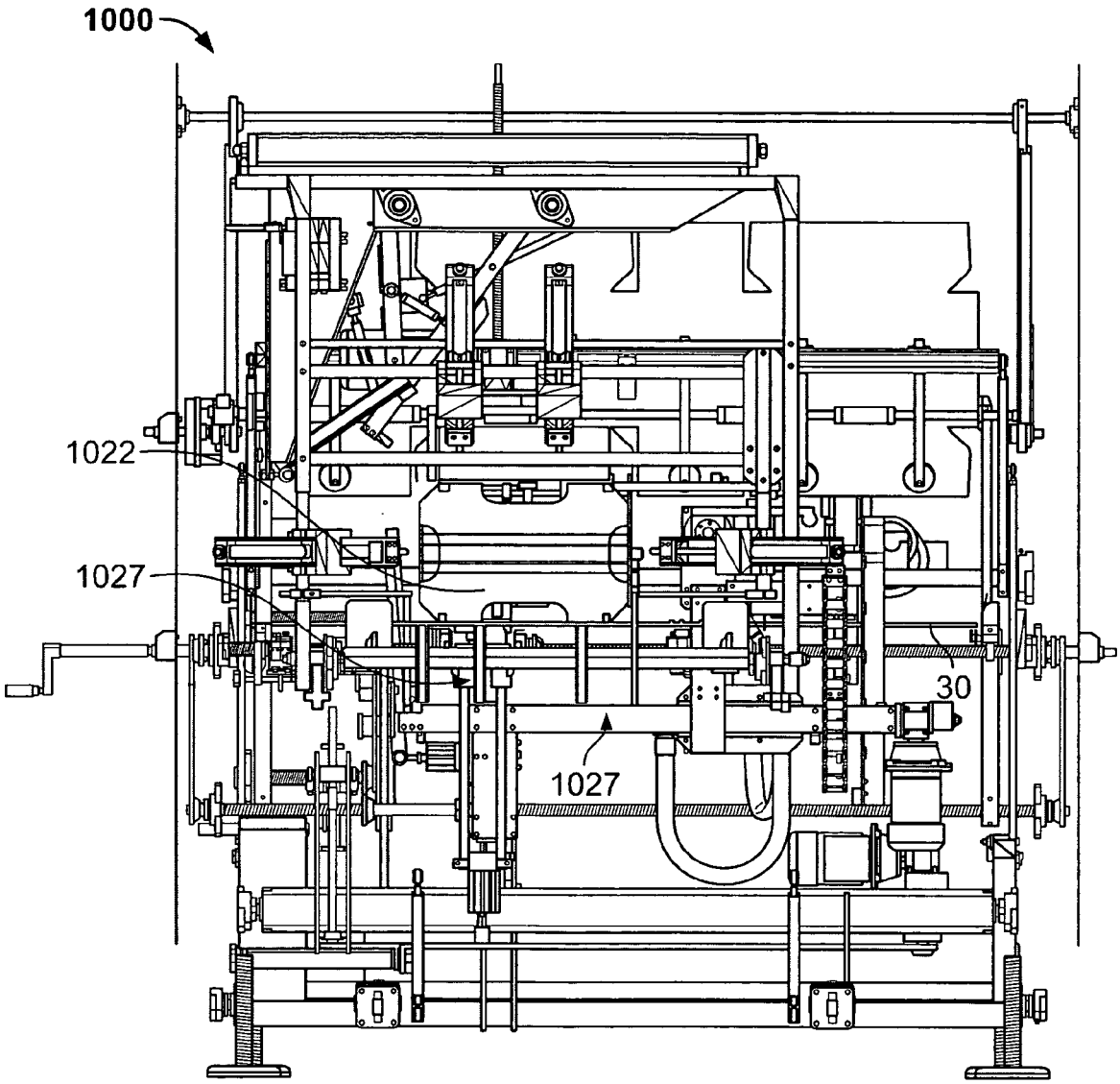
FIG. 16 is a front elevation view of the machine shown in FIG. 11.

As shown in FIG. 14, in one embodiment, pusher assembly 1016 pushes blank 30 over a plurality of hot melt glue guns 1020 for facilitating applying an adhesive material to surfaces (not shown) of blank 30, as desired. In an alternative embodiment, an adhesive material is applied to the desired surface(s) of blank 30 after the container is formed around the rotary head, as described in greater detail below. As shown in FIG. 15, pusher assembly 1016 guides blank 30 along support 1012 until blank 30 is underneath a mandrel 1022 rotatably mounted on a body 1024 of machine 1000. In one embodiment, mandrel 1022 includes a rotary head 1023 that has an external shape that is complimentary to at least a portion of an internal shape of container 200 constructed from blank 30. In this embodiment, rotary head 1023 has an external perimeter defining an octagon. However, it is apparent to those skilled in the art and guided by the teachings herein provided that rotary head 1023 may define any suitable external perimeter including, without limitation, a triangle, square, rectangle or other polygon to form a container having any suitable number of sides having any desired configuration with or without a top and/or bottom, in alternative embodiments. As described in further detail below, rotary head 1023 may be solid or may include at least one opening, such as a slot, defined within at least one surface for facilitating forming the blank of sheet material into a substantially fixed configuration with respect to a shape of rotary head 1023 as mandrel 1022 rotates about a rotational axis 1025. Pusher assembly 1016 pushes blank 30 along support 1012 to position blank 30 with respect to rotary head 1023.

Figure 17:
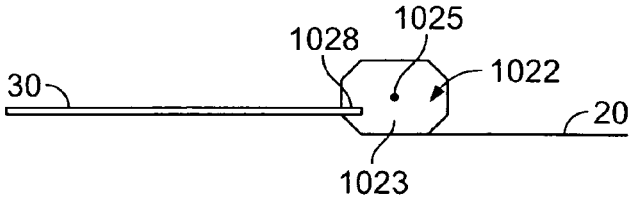
FIG. 17 is a schematic front view of an exemplary mandrel of the machine shown in FIG. 11 illustrating the blank shown in FIG. 1 positioned within a opening defined by the mandrel and the mandrel at an initial configuration.

Referring to FIGS. 16-21, a positioning assembly 1027 positions blank 30 within an opening 1028 (shown in FIG. 17) defined within at least one surface or face of rotary head 1023. Opening 1028 is positioned within at least one surface or face of rotary head 1023 such that blank 30 can be positioned in a lengthwise, widthwise or a diagonal direction within rotary head 1023. As shown in FIGS. 17-21, rotary head 1023 defines exterior surfaces having suitable dimensions that complement the dimensions of corresponding side panels of blank 30. In one embodiment, as shown in FIG. 17, opening 1028 is configured to receive and retain a portion of blank 30, such as intermediate side panel 40 shown in FIG. 1, within opening 1028 as rotary head 1023 rotates to construct container 200, as shown in FIG. 18-21. In one embodiment, mandrel 1022 and rotary head 1023 coupled to mandrel 1022 are rotatable in a counterclockwise rotational direction between about 0° and about 450° with intermediate side panel 40 positioned within opening 1028 to construct container 200. In this embodiment, rotary head 1023 rotates at a substantially constant continuous rotational speed. It is apparent to those skilled in the art and guided by the teachings herein provided that rotary head 1023 rotates less than or greater than 360° in a clockwise and/or a counterclockwise rotational direction in alternative embodiments, as described below. Further, in alternative embodiments, rotary head 1023 may continuously or discontinuously rotate at a constant or a variable rotational speed.

Figure 18:
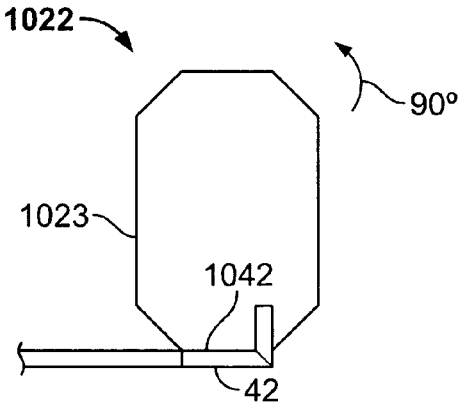
FIG. 18 is a schematic front view of the mandrel shown in FIG. 18 and the blank positioned within the opening at a 90° configuration with respect to the initial configuration.
Figure 19:
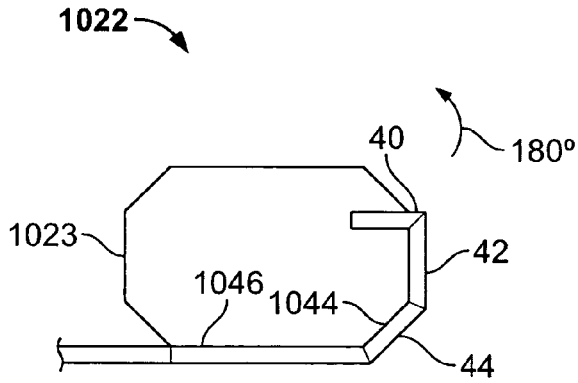
FIG. 19 is a schematic front view of the mandrel shown in FIG. 18 and the blank positioned within the opening at a 180° configuration with respect to the initial configuration.
Figure 20:
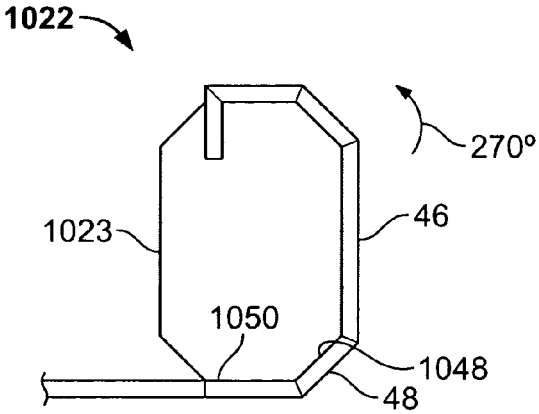
FIG. 20 is a schematic front view of the mandrel shown in FIG. 18 and the blank positioned within the opening at a 270° configuration with respect to the initial configuration.
Figure 21:
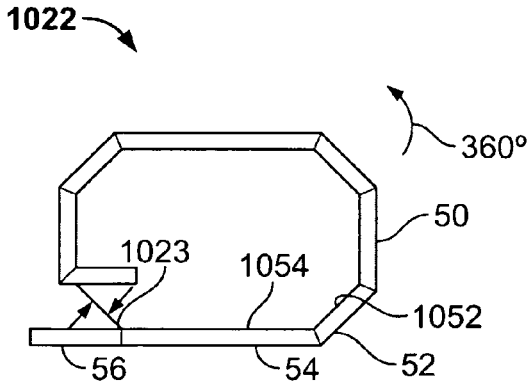
FIG. 21 is a schematic front view of the mandrel shown in FIG. 18 and the blank positioned within the opening at a final or 360° configuration with respect to the initial configuration.

FIG. 17 generally illustrates an initial position of blank 30 with respect to rotary head 1023 after intermediate side panel 40 has been positioned within opening 1028 and rotary head 1023 is at an initial configuration, e.g., a rotational angle of about 0°. As rotary head 1023 rotates towards a 90° configuration with respect to the initial configuration, as shown in FIG. 18, an interior surface of side panel 42 contacts a corresponding exterior surface 1042 of rotary head 1023. Rotary head 1023 continues to rotate towards a 180° configuration as shown in FIG. 19 to wrap side panel 42 and intermediate side panel 46 about rotary head 1023. At the 180° configuration, an interior surface of side panel 46 contacts a corresponding exterior surface 1046 of rotary head 1023. As shown in FIG. 20, rotary head 1023 continues to rotate toward a 270° configuration whereby wrapping side panel 46 and intermediate side panel 48 about rotary head 1023. In the 270° configuration, side panel 50 contacts a corresponding exterior surface 1050 of rotary head 1023. FIG. 21 generally shows blank 30 as wrapped around rotary head 1023 at a final configuration, e.g., a rotational angle of about 360° to about 450°, such that an interior surface of side panel 54 contacts a corresponding exterior surface 1054 of rotary head 1023. In this embodiment, as rotary head 1023 rotates between the initial configuration at about 0° to the final configuration at about 360° to about 450°, an interior surface of intermediate side panels 44, 48 and 52 contacts a corresponding exterior surface 1044, 1048 and 1052 of rotary head 1023, as shown in FIGS. 19-21. In an alternative embodiment, intermediate side panels 44, 48 and 52 may not necessarily contact corresponding exterior surface 1044, 1048 and 1052 as blank 30 is wrapped about rotary head 1023.

Figure 22:
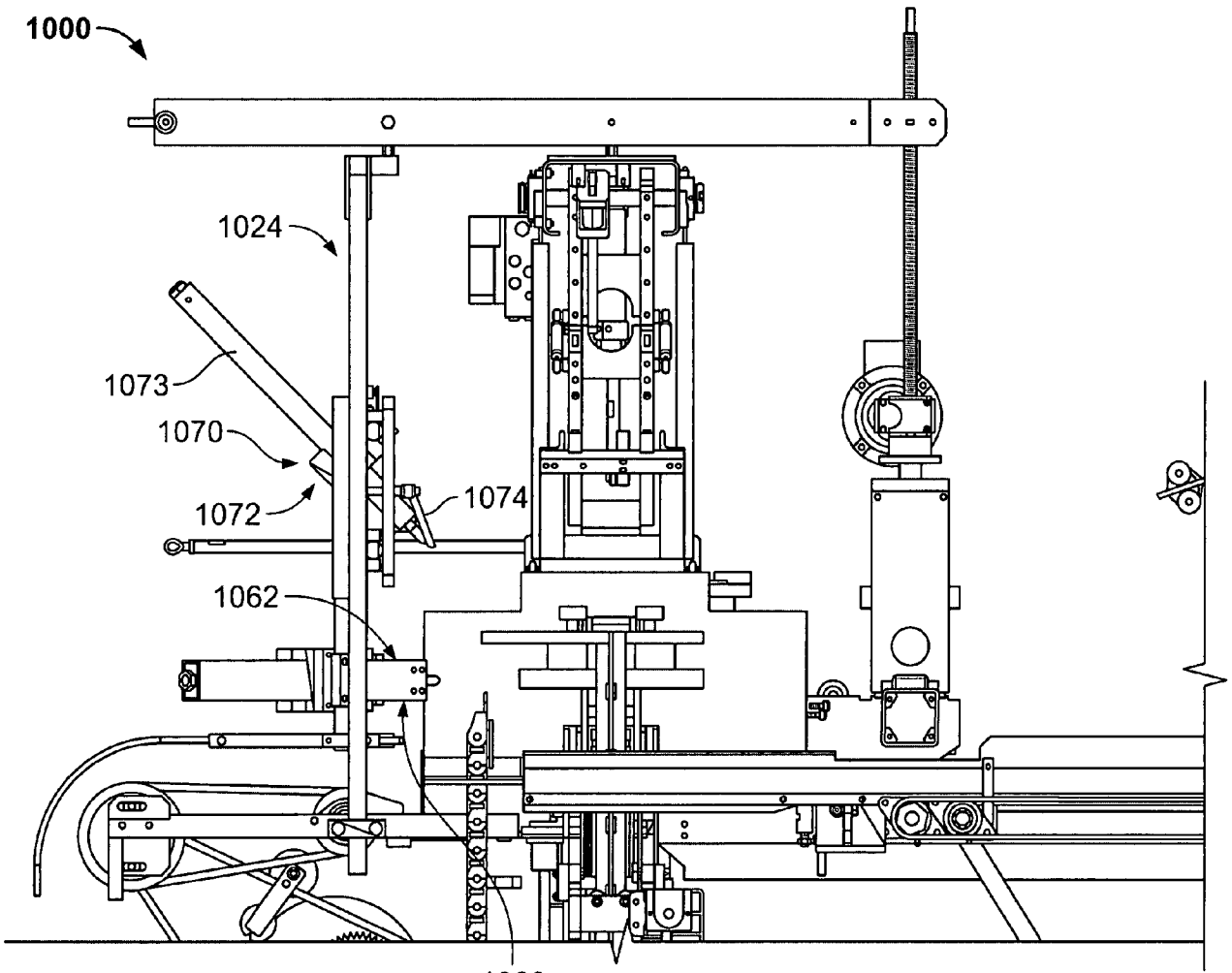
FIG. 22 is a side elevation view of a portion of the machine shown in FIG. 11.

With blank 30 wrapped around rotary head 1023 in a final configuration as shown in FIG. 21, intermediate side panel 40 is adhesively coupled to intermediate side panel 56 at manufacturing joint 258 to form side walls 242, 246, 250 and 254 and intermediate side walls 244, 248, 252 and 256 of container 200. Referring to FIG. 22, a folding member 1060 folds intermediate side panel 40 and intermediate side panel 56 tight against rotary head 1023. More specifically, folding member 1060 is movably mounted to body 1024 and an end 1062 of folding member 1060 engages intermediate side panel 40 and intermediate side panel 56 and folds intermediate side panel 40 along fold line 60 and intermediate side panel 56 along fold line 74 until intermediate side panel 40 and intermediate side panel 56 are tight against rotary head 1023. An adhesive material is applied to intermediate side panel 40 and/or intermediate side panel 56. Intermediate side panel 40 and/or intermediate side panel 56 are compressed to adhesively couple intermediate side panel 40 to intermediate side panel 56 at manufacturing joint 258. In one embodiment, the interior surface of intermediate side panel 40 is coupled to the exterior surface of intermediate side panel 56. In an alternative embodiment, the exterior surface of intermediate side panel 40 is coupled to the interior surface of intermediate side panel 56.

In one embodiment, a servomechanism 1070 is operatively coupled to folding member 1060 for driving and controlling movement of folding member 1060. In one embodiment, servomechanism 1070 includes an electric motor 1072 for driving rotation of folding member 1060 and at least one gear (not shown) for controlling an amount of torque output by motor 1072. In this embodiment, folding member 1060 rotates with respect to body 1024 when folding intermediate side panel 40 and/or intermediate side panel 56 against rotary head 1023.

As shown in FIG. 21, machine 1000 includes a flap folding member 1073 for forming or constructing bottom 270 of container 200. In one embodiment, flap folding member 1073 folds first bottom flap 84 and/or third bottom flap 118 against rotary head 1023 along respective fold lines 86 and 120 such that first bottom flap 84 and third bottom flap 118 are oriented generally perpendicular to respective side walls 242 and 250 of container 200. Flap folding member 1073 is movably mounted to body 1024 and an end 1074 of flap folding member 1073 engages first bottom flap 84 and/or third bottom flap 118 and folds first bottom flap 84 and/or third bottom flap 118 along respective fold lines until first bottom flap 84 and/or third bottom flap 118 is tight against rotary head 1023.

With first bottom flap 84 and third bottom flap 118 folded against rotary head 1023, flap folding member 1073 folds second bottom flap 98 and/or fourth bottom flap 132 against rotary head 1023 along respective fold lines 100 and 134 such that second bottom flap 98 and fourth bottom flap 132 are oriented generally perpendicular to respective side walls 246 and 254 of container 200. Flap folding member 1073 is movably mounted to body 1024 to engage second bottom flap 98 and/or fourth bottom flap 132 and fold second bottom flap 98 and/or fourth bottom flap 132 along respective fold lines until second bottom flap 98 and/or fourth bottom flap 132 is tight against rotary head 1023. In one embodiment, an adhesive material is applied to first bottom flap 84, second bottom flap 98, third bottom flap 118 and/or fourth bottom flap 132 before second bottom flap 98 and fourth bottom flap 132 are folded against rotary head 1023.

With second bottom flap 98 and fourth bottom flap 132 folded against rotary head 1023, a bottom presser member (not shown) mounted on body 1024 adjacent mandrel 1022 presses second bottom flap 98 and fourth bottom flap 132 against rotary head 1023 to adhesively secure second bottom flap 98 and/or fourth bottom flap 132 to first bottom flap 84 and/or third bottom flap 118. The bottom presser member includes a servomechanism (not shown) for driving and controlling movement of the bottom presser member. In one embodiment, the servomechanism includes an electric motor (not shown) operatively coupled to movable components of the bottom presser member. The bottom presser member may include any suitable structure, arrangement and/or configuration for providing a pressing component selectively positionable, sometimes referred to as toggled, between a first position wherein the pressing component does not apply a force to blank 30, bottom flaps 84, 98, 118 and/or 132, and a second position wherein the pressing component applies a force to bottom flaps 84, 98, 118 and/or 132 to compress adhesive material between the bottom flaps to form or construct bottom 270 of container 200.

Figure 23:
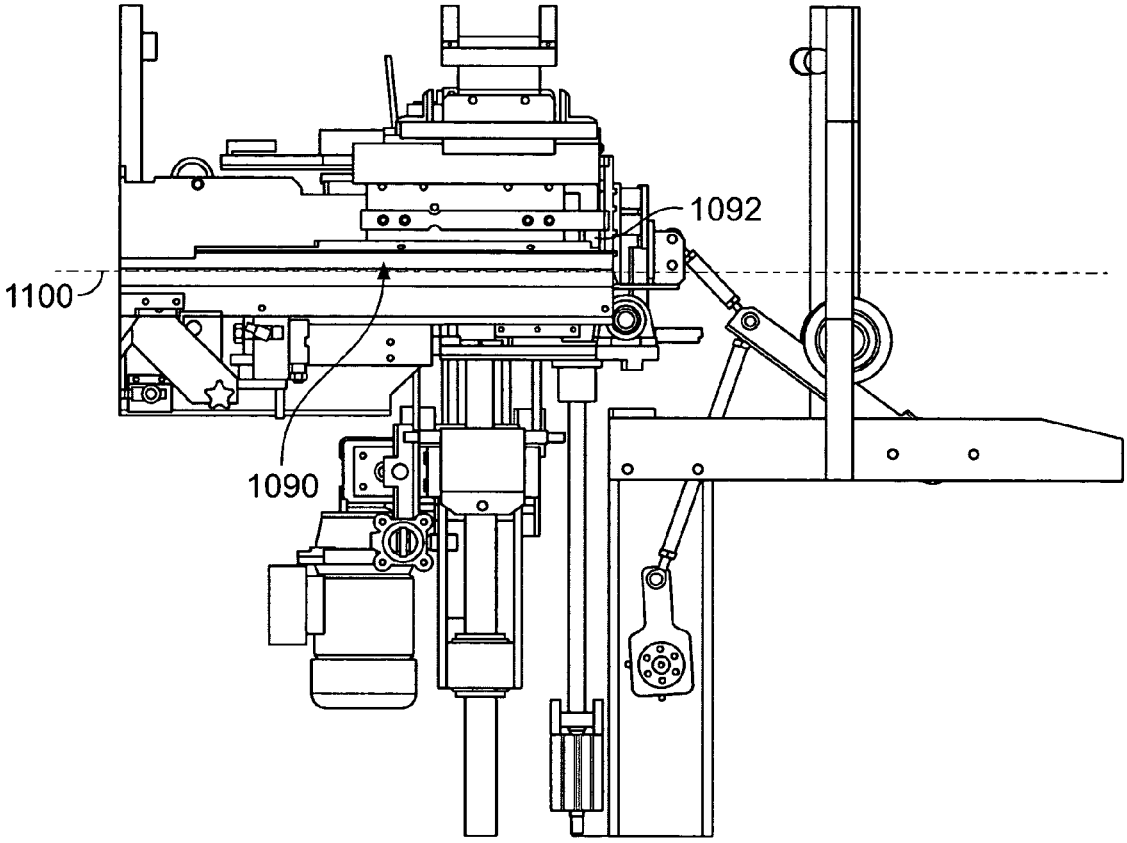
FIG. 23 is a side elevation view of a portion of the machine shown in FIG. 11.
Figure 24:
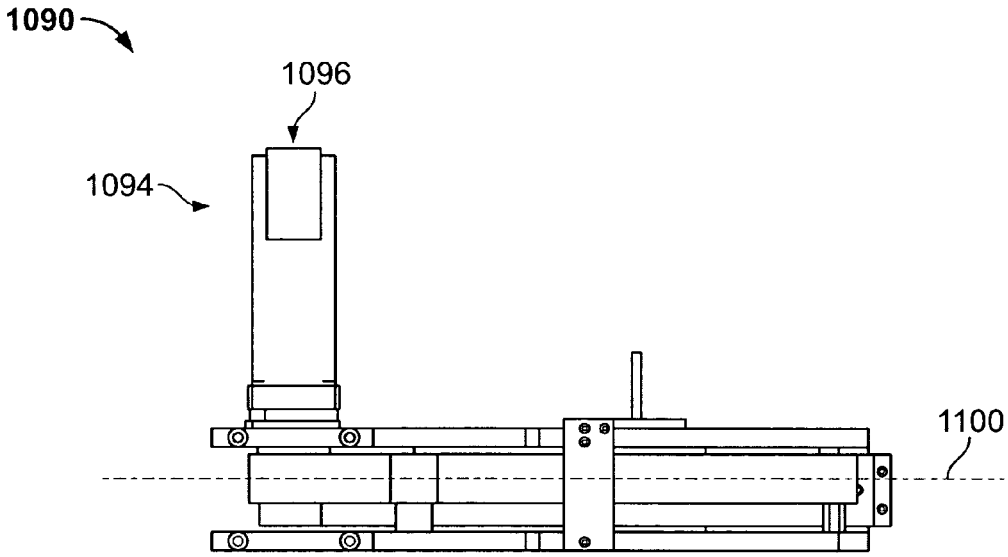
FIG. 24 is a side elevation view of an exemplary ejection mechanism of the machine shown in FIG. 11.

Once bottom 270 is formed, container 200 is constructed except for top 260, which may be formed or closed (and in some embodiments secured with an adhesive material) after filling container 200 with product. Container 200 is ejected from rotary head 1023 and machine 1000. In one embodiment, machine 1000 includes an ejection mechanism 1090 having an ejection plate 1092 positioned with respect to rotary head 1023 that is configured to apply a suitable force to an interior surface of bottom 270 to eject container 200 from rotary head 1023. More specifically, and as shown in FIGS. 23, ejection plate 1092 is movable along an axis 1100 in a direction away from mandrel 1022 to eject container 200 from rotary head 1023 and machine 1000. In this embodiment, ejection plate 1092 moves between about 10 inches and about 30 inches along axis 1100 to eject container 200 from rotary head 1023 and machine 1000. In alternative embodiments, ejection plate 1092 moves any suitable distance along axis 1100 to eject container 200 from rotary head 1023 and machine 1000. In one embodiment, a compression force between ejection plate 1092 and the bottom presser member facilitates compressing adhesive material between bottom flaps 84, 98, 118 and/or 132.

Figure 25:
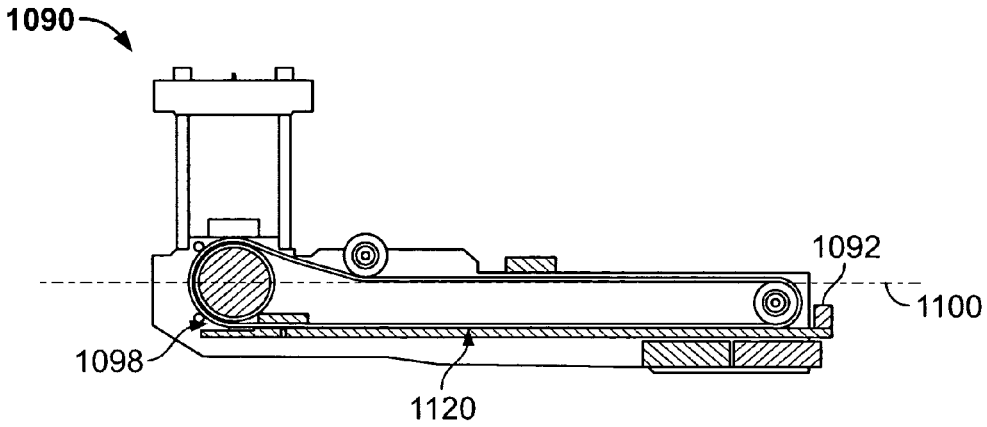
FIG. 25 is a side elevation view of the ejection mechanism shown in FIG. 24.

In one embodiment, ejection mechanism 1090 includes a servomechanism 1094 for driving and controlling movement of ejection plate 1092. In this embodiment, servomechanism 1094 includes an electric motor 1096 that includes an output shaft 1098 (shown in FIG. 25) for driving rotation of a conveyor 1120 coupled to ejection plate 1092. It is apparent to those skilled in the art and guided by the teachings herein provided that container 200 may be ejected from rotary head 1023 and machine 1000 using any suitable mechanism, and/or structure in alternative embodiments.

As shown in FIGS. 26-30, in an alternative embodiment, rotary head 1023 is configured to receive blank 330, as shown in FIG. 5. In this embodiment, rotary head 1023 has an external shape that is complimentary to at least a portion of an internal shape of container 500 (shown in FIG. 6) constructed from blank 330. Pusher assembly 1016 pushes blank 330 along support 1012 to position blank 330 with respect to rotary head 1023.

Referring to FIGS. 26-30, positioning assembly 1027 positions blank 330 within an opening 1128 defined within a front face of rotary head 1023 and extending between a first side face and an opposing second side face of rotary head 1023. Opening 1128 defined within rotary head 1023 such that blank 330 can be positioned in a lengthwise, widthwise or a diagonal direction within rotary head 1023. As shown in FIGS. 26-30, rotary head 1023 includes exterior surfaces having suitable dimensions that complement the dimensions of corresponding side panels of blank 330. In one embodiment, as shown in FIG. 21, opening 1128 is configured to receive and retain a portion of blank 330, such as divider panel 376 shown in FIG. 5. Blank 330 is positioned through the first face of rotary head 1023 and tab 378 of blank 330 extends outwardly from the opposing second face of rotary head 1023. Divider panel 376 is positioned within opening 1128 such that fold line 379 is positioned at a transition line between the second face and opening 1128 and fold line 377 coupling divider panel 376 to side panel 340 is positioned at a transition line between the first face and opening 1128. Divider panel 376 is retained within opening 1128 as rotary head 1023 rotates to construct container 500.

In one embodiment, mandrel 1022 and rotary head 1023 is rotatable in a counterclockwise rotational direction between about 0° and about 360° with divider panel 376 positioned within opening 1128 to construct container 500. In this embodiment, rotary head 1023 rotates at a substantially constant continuous rotational speed. It is apparent to those skilled in the art and guided by the teachings herein provided that rotary head 1023 rotates less than or greater than 360° in a clockwise and/or a counterclockwise rotational direction in alternative embodiments. Further, in alternative embodiments, rotary head 1023 may continuously or discontinuously rotate at a constant or a variable rotational speed.

Figure 26:
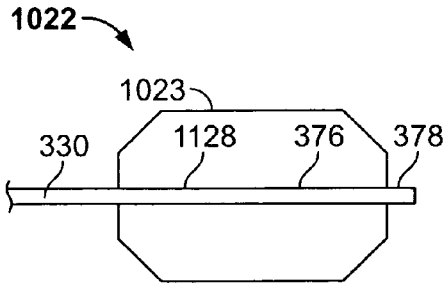
FIG. 26 is a schematic front view of an exemplary mandrel of the machine shown in FIG. 11 illustrating the blank shown in FIG. 5 positioned within a opening defined by the mandrel and the mandrel at an initial configuration.
Figure 27:
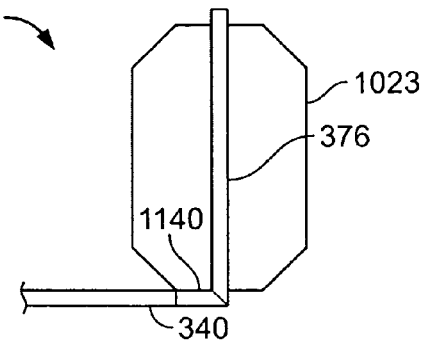
FIG. 27 is a schematic front view of the mandrel shown in FIG. 26 and the blank positioned within the opening at a 90° configuration with respect to the initial configuration.
Figure 28:
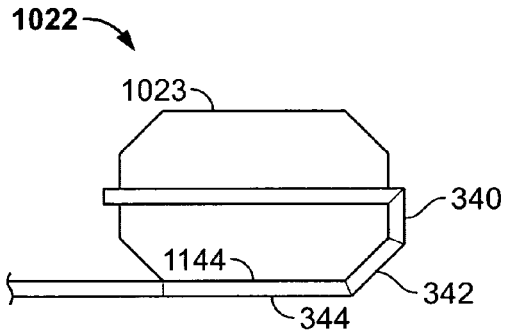
FIG. 28 is a schematic front view of the mandrel shown in FIG. 26 and the blank positioned within the opening at a 180° configuration with respect to the initial configuration.
Figure 29:
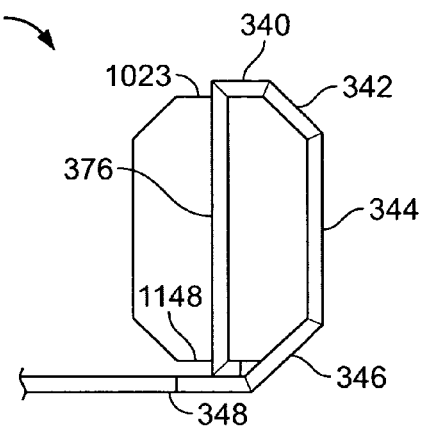
FIG. 29 is a schematic front view of the mandrel shown in FIG. 26 and the blank positioned within the opening at a 270° configuration with respect to the initial configuration.

FIG. 26 generally illustrates an initial position of blank 330 with respect to rotary head 1023 after divider panel 376 has been positioned within opening 1128 and rotary head 1023 is at an initial configuration, e.g., a rotational angle of about 0°. As rotary head 1023 rotates towards a 90° configuration with respect to the initial configuration, as shown in FIG. 27, an interior surface of side panel 340 contacts a corresponding exterior surface 1140 of rotary head 1023. Rotary head 1023 continues to rotate towards a 180° configuration as shown in FIG. 28 to wrap side panel 340 and intermediate side panel about rotary head 1023. At the 180° configuration, an interior surface of side panel 344 contacts a corresponding exterior surface 1144 of rotary head 1023. As shown in FIG. 29, mandrel 1022 continues to rotate toward a 270° configuration whereby wrapping side panel 344 and intermediate side panel 346 about rotary head 1023. In the 270° configuration, at least a portion of side panel 348 contacts a corresponding exterior surface 1148 of rotary head 1023. Further, tab 378 is folded along fold line 379 such that an interior surface of tab 378 contacts exterior surface 1148. In one embodiment, an adhesive material is applied to an opposing exterior surface of tab 378 and/or a corresponding portion of the interior surface of side panel 348 before mandrel 1022 rotates to the 270° configuration. With rotary head 1023 in the 270° configuration, a force applied by rotary head 1023 and/or a support surface facilitates adhesively coupling tab 378 to the interior surface of side panel 348 to form divider 590 of container 500 (shown in FIG. 7).

Figure 30:
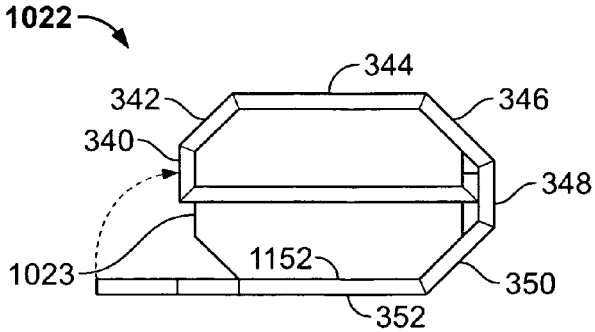
FIG. 30 is a schematic front view of the mandrel shown in FIG. 26 and the blank positioned within the opening at a final or 360° configuration with respect to the initial configuration.

FIG. 30 generally shows blank 330 as wrapped around rotary head 1023 at a final configuration, e.g., a rotational angle of about 360°, such that an interior surface of side panel 352 contacts a corresponding exterior surface 1152 of rotary head 1023. In this embodiment, as rotary head 1023 rotates between the initial configuration at about 0° to the final configuration at about 360°, an interior surface of intermediate side panels 342, 346 and 350 contacts a corresponding exterior surface 1142, 1146 and 1150 of rotary head 1023, as shown in FIGS. 27-30. In an alternative embodiment, intermediate side panels 342, 346 and/or 350 may not necessarily contact corresponding exterior surface 1142, 1146 and 1150 as blank 330 is wrapped about rotary head 1023.

In one embodiment, with blank 330 wrapped around rotary head 1023 in a final configuration as shown in FIG. 30, intermediate side panel 354 is folded along fold line 372 such that an interior surface of intermediate side panel 354 contacts a corresponding exterior surface 1154 of rotary head 1023. Further, side panel 356 is folded along fold line 374 to contact an exterior surface of side panel 340. The interior surface of side panel 356 is adhesively coupled using a suitable adhesive material to the exterior surface of side panel 340 at manufacturing joint 541 to form side walls 540, 544, 548 and 552 and intermediate side walls 542, 546, 550 and 554 of container 500. In an alternative embodiment, rotary head 1023 is rotatable about 90° in a counter clockwise direction from the 360° configuration to a 450° configuration such that intermediate side panel 354 is wrapped about rotary head 1023 and side panel 356 is folded along fold line 374 to contact the exterior surface of side panel 340. Before or during the rotation of rotary head 1023 to the 450° configuration, an adhesive material is applied to the interior surface of side panel 356 and/or the exterior surface of side panel 340. In the 450° configuration, the adhesive material is compressed between side panel 340 and side panel 356 to adhesively couple side panel 340 and side panel 356.

Bottom 570 is then formed or constructing by folding first bottom flap 384 and fifth bottom flap 452 against rotary head 1023 along respective fold line 386 and 454 such that first bottom flap 384 and fifth bottom flap 452 are oriented generally perpendicular to side wall 540 of container 500. Similarly, third bottom flap 418 is folded against rotary head 1023 along fold line 420 such that third bottom flap 418 is oriented generally perpendicular to side wall 548 of container 500. Second bottom flap 398 is then folded against first bottom flap 384 and/or fifth bottom flap 452 and opposing third bottom flap 418 and adhesively coupled to first bottom flap 384, third bottom flap 418 and/or fifth bottom flap 452. Fourth bottom flap 432 is folded against first bottom flap 384 and/or fifth bottom flap 452 and opposing third bottom flap 418 and adhesively coupled to first bottom flap 384, third bottom flap 418 and/or fifth bottom flap 452.

Once bottom 570 is formed, container 500 is constructed except for top 560, which may be formed or closed (and in some embodiments secured with an adhesive material) after filling container 500 with product. Container 500 is ejected from rotary head 1023 and machine 1000 and another blank 330 is positioned within opening 1128.

As shown in FIGS. 31-34, in an alternative embodiment, mandrel 1022 is configured to receive blank 630, as shown in FIG. 8. In this embodiment, rotary head 1023 has an external shape that is complimentary to at least a portion of an internal shape of container 800 (shown in FIG. 9) constructed from blank 630. Pusher assembly 1016 pushes blank 630 along support 1012 to position blank 630 with respect to mandrel 1022.

Figure 31:
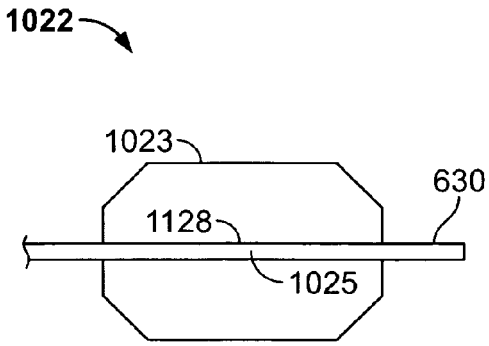
FIG. 31 is a schematic front view of an exemplary mandrel of the machine shown in FIG. 11 illustrating the blank shown in FIG. 8 positioned within a opening defined by the mandrel and the mandrel at an initial configuration.

Referring to FIGS. 31-34, positioning assembly 1027 positions blank 630 within opening 1128 defined within a front face of rotary head 1023 and extending between a first side face and an opposing second side face of rotary head 1023. Opening 1128 defined within rotary head 1023 such that blank 630 can be positioned in a lengthwise, widthwise or a diagonal direction within mandrel 1022. As shown in FIGS. 31-34, rotary head 1023 includes exterior surfaces having suitable dimensions that complement the dimensions of corresponding side panels of blank 630. In one embodiment, as shown in FIG. 31, opening 1128 is configured to receive and retain a portion of blank 630, such as divider panel 650 shown in FIG. 8. Blank 630 is slidably positioned through the first face of rotary head 1023 with a lead portion of blank 630 extending outwardly from the opposing second face of rotary head 1023 and a trailing portion of blank 630 extending outwardly from the first face of rotary head 1023. More specifically, fold line 670 coupling divider panel 650 to side panel 648 is positioned along a transition line between the second side face of rotary head 1023 and opening 1128 and fold line 672 coupling divider panel 650 to side panel 652 is positioned along a transition line between the first side face of rotary head 1023 and opening 1128. Divider panel 650 is retained within opening 1128 as mandrel 1022 rotates to construct container 800.

In this embodiment, rotary head 1023 is rotatable in a counterclockwise or clockwise rotational direction between about 0° and about 270° with divider panel 650 positioned within opening 1128 to construct container 800. Further, mandrel 1022 rotates at a substantially constant continuous rotational speed. It is apparent to those skilled in the art and guided by the teachings herein provided that rotary head 1023 rotates less than or greater than 270° in a clockwise and/or a counterclockwise rotational direction in alternative embodiments. Further, in alternative embodiments, rotary head 1023 may continuously or discontinuously rotate at a constant or a variable rotational speed.

Figure 32:
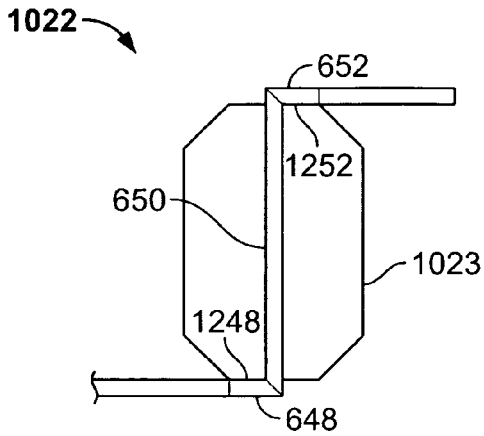
FIG. 32 is a schematic front view of the mandrel shown in FIG. 31 and the blank positioned within the opening at a 90° configuration with respect to the initial configuration.
Figure 33:
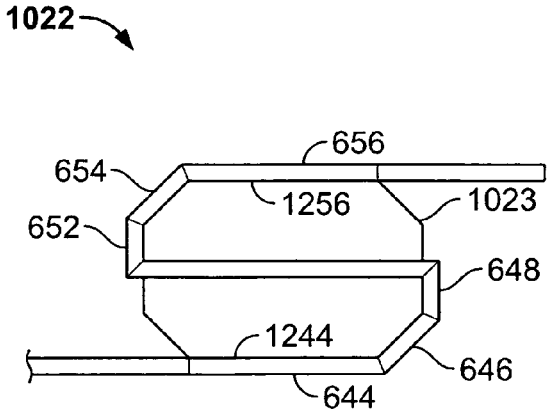
FIG. 33 is a schematic front view of the mandrel shown in FIG. 31 and the blank positioned within the opening at a 180° configuration with respect to the initial configuration.

FIG. 31 generally illustrates an initial position of blank 630 with respect to mandrel 1022 after divider panel 650 has been positioned within opening 1128 and mandrel 1022 is at an initial configuration, e.g., a rotational angle of about 0°. As rotary head 1023 rotates towards a 90° configuration with respect to the initial configuration, as shown in FIG. 32, an interior surface of side panel 648 contacts a corresponding exterior surface 1248 of rotary head 1023 and an interior surface of side panel 652 contacts a corresponding opposing exterior surface 1252 of rotary head 1023. Rotary head 1023 continues to rotate towards a 180° configuration as shown in FIG. 33 to wrap side panel 648 and coupled intermediate side panel 646 and side panel 652 and coupled intermediate side panel 654 about rotary head 1023. At the 180° configuration, an interior surface of side panel 644 contacts a corresponding exterior surface 1244 of rotary head 1023 and an interior surface of side panel 656 contact a corresponding opposing exterior surface 1256 of rotary head 1023.

Figure 34:
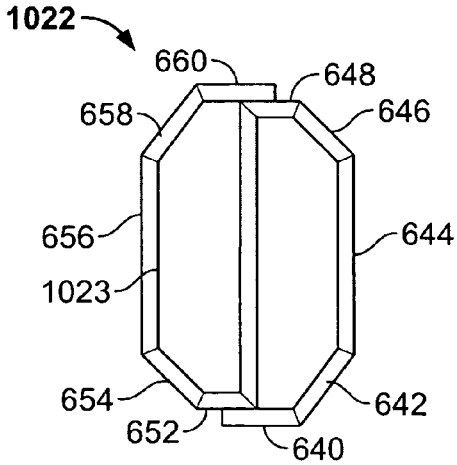
FIG. 34 is a schematic front view of the mandrel shown in FIG. 26 and the blank positioned within the opening at a final or 270° configuration with respect to the initial configuration.
Figure 35:
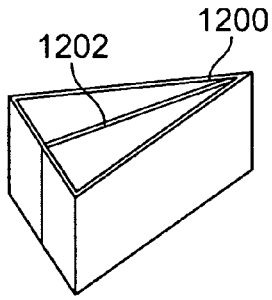
FIGS. 35-43 illustrate exemplary containers constructed in accordance with the present invention.
Figure 36:
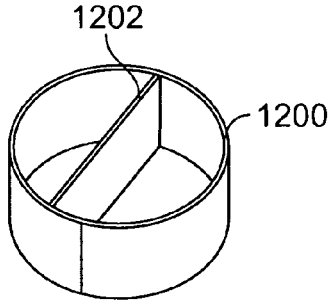
Figure 37:
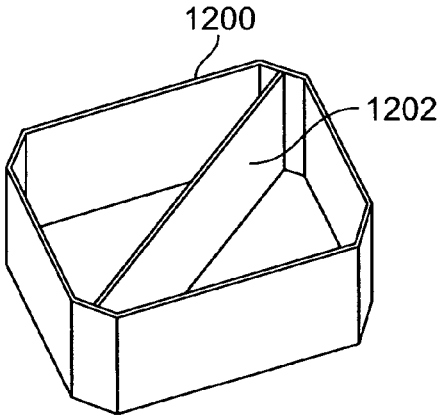

FIG. 34 generally shows blank 630 wrapped around rotary head 1023 at a final configuration, e.g., a rotational angle of about 270°, such that an interior surface of side panel 640 contacts a corresponding exterior surface of side panel 652 and an interior surface of side panel 660 contacts an exterior surface of side panel 648. As shown in FIG. 34, rotary head 1023 continues to rotate toward a 270° configuration whereby wrapping side panel 644 and coupled intermediate side panel 642 and side panel 656 and coupled intermediate side panel 658 about rotary head 1023. In the 270° configuration, side panel 640 is folded along fold line 662 such that at least a portion of the interior surface of side panel 640 contacts a corresponding exterior surface 1240 of rotary head 1023. Similarly, side panel 660 is folded along fold line 680 such that at least a portion of the interior surface of side panel 660 contacts a corresponding exterior surface 1260 of rotary head 1023.

In this embodiment, as mandrel 1022 rotates between the initial configuration at about 0° to the final configuration at about 270°, an interior surface of intermediate side panels 642, 646, 654 and 658 contacts a corresponding exterior surface 1242, 1246, 1254 and 1258 of rotary head 1023, as shown in FIG. 34. In an alternative embodiment, intermediate side panels 642, 646, 654 and/or 658 may not necessarily contact corresponding exterior surface 1242, 1246, 1254 and 1258 as blank 630 is wrapped about rotary head 1023.

In one embodiment, with blank 630 wrapped around rotary head 1023 in a final configuration as shown in FIG. 34, side panel 640 is folded along fold line 662 such that an interior surface of side panel 640 contacts an exterior surface of side panel 652. The interior surface of side panel 640 is adhesively coupled using a suitable adhesive material to the exterior surface of side panel 652 at manufacturing joint 841 (shown in FIG. 9). Similarly, side panel 660 is folded along fold line 680 such that an interior surface of side panel 660 contacts an exterior surface of side panel 648. The interior surface of side panel 660 is adhesively coupled using a suitable adhesive material to the exterior surface of side panel 648 at manufacturing joint 849 (shown in FIG. 9). Side panel 640 is coupled to side panel 652 at manufacturing joint 841 and side panel 660 is coupled to side panel 648 at manufacturing joint 849 to form side walls 840, 844, 848 and 852 and intermediate side walls 842, 846, 850 and 854 of container 800.

Bottom 870 is then formed or constructing by folding first bottom flap 684 and fourth bottom flap 732 against the front face of mandrel 1022 along respective fold line 686 and 734 such that first bottom flap 684 and fourth bottom flap 732 are oriented generally perpendicular to side wall 840 of container 800. Similarly, third bottom flap 718 and sixth bottom flap 764 are folded against the front face of mandrel 1022 along respective fold lines 720 and 766 such that third bottom flap 718 and sixth bottom flap 764 are oriented generally perpendicular to side wall 848 of container 800. Second bottom flap 698 is then folded along fold line 700 against first bottom flap 684 and/or third bottom flap 718 and opposing fifth bottom flap 744 is folded along fold line 746 against fourth bottom flap 732 and sixth bottom flap 764. In one embodiment, second bottom flap 698 is adhesively coupled to first bottom flap 684 and/or third bottom flap 718 and fifth bottom flap 744 is adhesively coupled to fourth bottom flap 732 an/or sixth bottom flap 764 to form bottom 870.

Once bottom 870 is formed, container 800 is constructed except for top 860, which may be formed or closed (and in some embodiments secured with an adhesive material) after filling container 800 with product. Container 800 is ejected from rotary head 1023 and machine 1000 and another blank 630 is positioned within opening 1128.

In one embodiment, a method for constructing a container using a machine is provided. A blank of sheet material including a plurality of panels coupled together at a plurality of fold lines is advanced into the machine. A first panel of the plurality of panels is positioned within an opening formed in a rotary head of the machine. The rotary head rotates about a rotational axis to construct the container. The blank of sheet material is wrapped about the rotary head as the rotary head rotates with the mandrel about the rotational axis. As the blank of sheet material is wrapped about the rotary head, each panel is folded along corresponding fold lines for facilitating forming side walls and/or intermediate side walls of the container. At least one manufacturing joint is formed to couple the first panel to a second panel of the plurality of panels.

In one embodiment, the rotary head rotates about a rotational axis between about 0° and about 450° to construct the container. In a particular embodiment, the rotary head rotates between about 0° and about 270°. In another particular embodiment, the rotary head rotates between about 360° and about 450°. It is apparent to those skilled in the art and guided by the teachings herein provided that the rotary head may rotate any suitable number of cycles about the rotational axis and/or between any suitable degrees of rotation. The rotary head is rotatable in a clockwise rotational direction and/or a counterclockwise rotational direction. Further, the rotary head is rotatable at constant rotational speed or a variable rotational speed in a continuous rotational pattern or a discontinuous rotational pattern.

Referring to FIGS. 1-4 and 18-21, in one embodiment, intermediate side panel 40 is positioned within opening 1128. Mandrel 1022 is rotated at least 360° about rotational axis 1025. As mandrel 1022 rotates about rotational axis 1025, blank of sheet material 30 is wrapped about rotary head 1023 and each panel is folded against a corresponding exterior surface of rotary head 1023. Intermediate side panel 26 is coupled to intermediate side panel 40 at manufacturing joint 258 to at least partially construct container 200. In a particular embodiment, rotary head 1023 is rotated about 450° for facilitating coupling intermediate side panel 56 to intermediate side panel 40 at manufacturing joint 258. In a particular embodiment, intermediate side panel 56 is coupled to intermediate side panel 40 by applying an adhesive material to an exterior surface of intermediate side panel 40 and/or an interior surface of intermediate side panel 56. Intermediate side panel 56 is folded along a corresponding fold line 74 such that the interior surface of intermediate side panel 56 contacts the exterior surface of intermediate side panel 40. The adhesive material couples intermediate side panel 56 to intermediate side panel 40 to form intermediate side wall 256 of container 200. After container 200 has been formed, container 200 is ejected from about mandrel 1022 and a second blank of sheet material 30 is positioned with respect to mandrel 1022.

Referring to FIGS. 5-7 and 26-30, in one embodiment, a divider panel 376 of blank of sheet material 330 is positioned within opening 1128 defined within a front face of rotary head 1023 and extending into a first side face of rotary head 1023 and an opposing second side face of rotary head 1023. Divider panel 376 is coupled at a first side edge to side panel 340 of blank of sheet material 330 along fold line 377. Rotary head 1023 is rotated in a counterclockwise rotational direction about 270° about rotational axis 1025. A tab 378 that extends from a second side edge of divider panel 376 along fold line 379 is coupled to an interior surface of side panel 348 of blank of sheet material 330 at a first manufacturing joint with side panel 348 folded against rotary head 1023. In a particular embodiment, an adhesive material is coupled to an interior surface and/or an exterior surface of tab 378 and an interior surface of side panel 348. Tab 378 is folded along fold line 379 to adhesively couple the interior surface or the exterior surface of tab 378 to the interior surface of side panel 348.

Rotary head 1023 is then rotated at least about 90° in the counterclockwise rotational direction about rotational axis 1025 and side panel 356 is coupled to side panel 340 at a second manufacturing joint. In a particular embodiment, an adhesive material is applied to an interior surface of side panel 356 and/or an exterior surface of side panel 340. Side panel 356 is folded along a fold line 374 coupling side panel 356 to intermediate side panel 354. The interior surface of side panel 356 is pressed against the exterior surface of side panel 340 to adhesively couple side panel 356 to side panel 340. In this embodiment, a divider 590 of container 500 is formed for facilitating compartmentalizing a cavity 502 defined within container 500 and/or providing support to container 500. In another particular embodiment, rotary head 1023 is rotated about 180° in the counterclockwise rotational direction about rotational axis 1025 to couple an interior surface of side panel 356 to an exterior surface of side panel 340. An adhesive material is applied to the interior surface of side panel 356 and/or the exterior surface of side panel 340 before rotating mandrel 1022 about 180° in the counterclockwise rotational direction. After container 500 has been formed, container 500 is ejected from about mandrel 1022 and a second blank of sheet material 330 is positioned with respect to mandrel 1022.

Referring to FIGS. 8-10 and 31-34, in one embodiment, divider panel 650 of blank of sheet material 630 is positioned within opening 1128 defined within a front face of rotary head 1023 that extends into a first side face of rotary head 1023 and an opposing second side face of rotary head 1023. Divider panel 650 is coupled at a first side edge along a first fold line 670 to a first portion of blank of sheet material 630 extending outwardly from the first side face of rotary head 1023. Similarly, divider panel 650 is coupled at an opposing second side edge along a second fold line 672 to a second portion of blank of sheet material 630 extending outwardly from the second side face of rotary head 1023. Mandrel 1022 is rotated about 90° in a counterclockwise rotational direction about rotational axis 1025. As mandrel 1022 rotates, an interior surface of side panel 648 of the first portion is folded against the first side face of rotary head 1023 and an exterior surface of side panel 652 of the second portion is folded against the second side face of rotary head 1023. Rotary head 1023 is then rotated about 180° in the counterclockwise rotational direction about rotational axis 1025. Side panel 640 of the first portion is coupled to side panel 652 at a first manufacturing joint. Side panel 660 of the second portion is coupled to side panel 648 at a second manufacturing joint.

In one embodiment, an adhesive material is applied to an interior surface of side panel 652 and/or an interior surface of side panel 640. Side panel 640 is folded along a fold line 662 that couples side panel 640 to intermediate side panel 642. The interior surface of side panel 640 is pressed against the interior surface of side panel 652 to adhesively couple side panel 640 to side panel 652 at the first manufacturing joint. Further, an adhesive material is applied to an exterior surface of side panel 648 and/or an exterior surface of side panel 660. Side panel 660 is folded along a fold line 680.that couples side panel 660 to intermediate side panel 658. The exterior surface of side panel 660 is pressed against the exterior surface of side panel 648 to adhesively couple side panel 660 to side panel 648 at the second manufacturing joint. In this embodiment, a divider 890 of container 800 is formed for facilitating compartmentalizing a cavity 802 defined within container 800 and/or providing support to container 800. After container 800 has been formed, container 800 is ejected from about rotary head 1023 and a second blank of sheet material 630 is positioned with respect to rotary head 1023.

In one embodiment, the apparatus and/or method provide a shorter cycle time for constructing a container when compared to conventional apparatus and/or methods. The apparatus and/or method facilitate constructing containers at about a 1.5 second cycle time. A reduction in cycle time of about 0.1 second equates to a 6.6% improvement in cycle time efficiency, or an improvement of about 2.6 cycles per minute.

The above-described container is constructed by a machine having a rotatable mandrel with a rotary head for facilitating forming the blank of sheet material into a substantially fixed configuration with respect to a shape of the rotary head as the mandrel rotates about the rotational axis. The blank of sheet material is maintained within a slot or opening defined in the rotary head. The exterior of the rotary head defines a plurality of surfaces that correspond to a panel of the blank for facilitating accurate folding and forming of the side walls and intermediate side walls of the container as the mandrel rotates.

Figure 38:
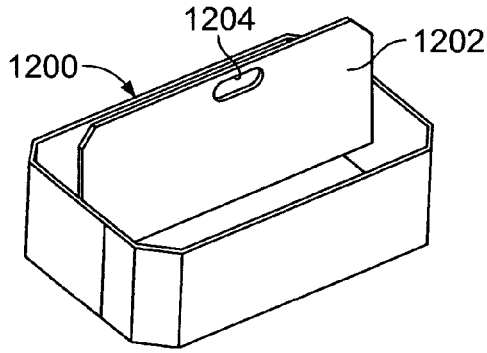
Figure 39:
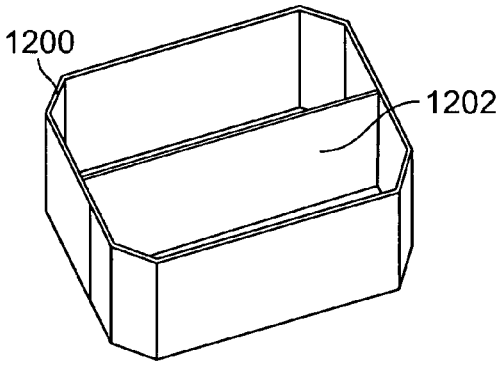
Figure 40:
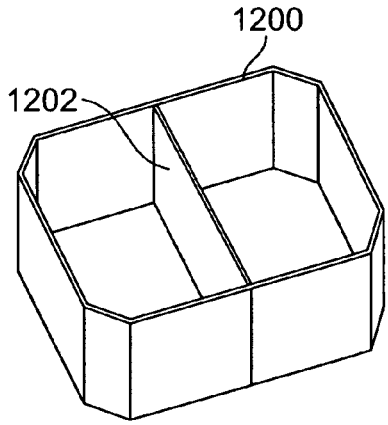
Figure 41:
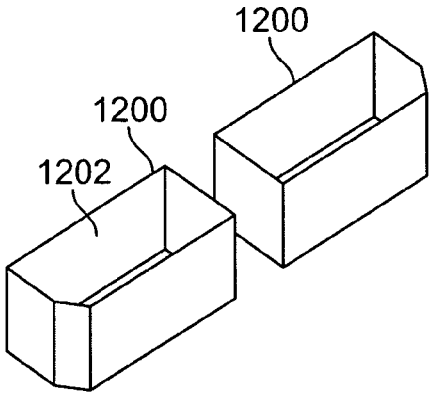
Figure 42:
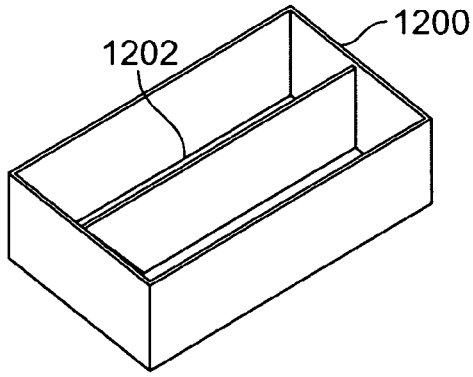
Figure 43:
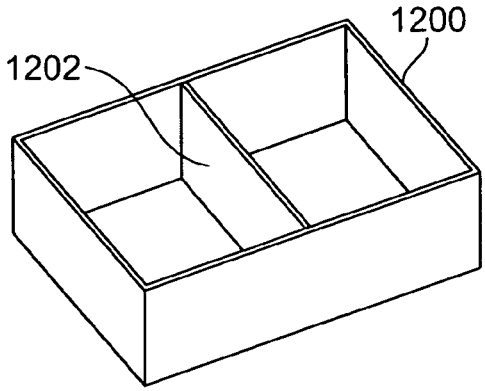

FIGS. 35-43 illustrate exemplary containers 1200, such as boxes or sleeves, constructed according to the present invention. In one embodiment, container 1200 includes a top and/or a bottom to form a box. In an alternative embodiment, container 1200 does not include a top and/or a bottom to form a sleeve. In one embodiment, container 1200 includes a divider 1202 that extends through a cavity formed by container 1200 in any suitable direction, such as a lateral, a longitudinal or a diagonal direction. In a particular embodiment, divider 1202 has a height equal to the height of one or more of the container walls, such as shown in FIGS. 35-37 and 39-43. In an alternative embodiment, divider 1202 has a height different from the height of one or more of the container walls, e.g., divider 1202 has a height greater than or less than the height of one or more of the container walls, such as shown in FIG. 38. Further, as shown in FIG. 38, divider 1202 forms an opening 1204 for facilitating transporting container 1200.

Exemplary embodiments of a container constructed from a blank of sheet material and an apparatus and method for constructing the container are described above in detail. The blank, apparatus and method are not limited to the specific embodiments described herein, but rather, components of the container or apparatus and/or steps of the method may be utilized independently and separately from other components and/or steps described herein. Further, the described container components, apparatus components and/or method steps can also be defined in, or used in combination with, other containers, apparatus and/or methods, and are not limited to practice with only the containers, apparatus and method as described herein.

While the invention has been described in terms of various specific embodiments, those skilled in the art will recognize that the invention can be practiced with modification within the spirit and scope of the claims.

What is claimed is:

1. A method for constructing a container from a blank of sheet material using a machine, the machine including a frame and a mandrel having a rotary head coupled to a mounting arm, the mounting arm having a first end rotatably coupled to the frame and an opposing second end fixedly coupled to the rotary head, the rotary head defining a bottom face and a plurality of exterior surfaces including a plurality of side faces, a rotational axis extending parallel to the mounting arm and perpendicular to the bottom face of the rotary head, the rotary head forming an opening in at least one exterior surface of the plurality of exterior surfaces configured to receive a portion of the blank for facilitating forming the blank into a configuration with respect to a shape of the rotary head as the mandrel rotates about the rotational axis, the method comprising:

providing the blank of sheet material comprising a plurality of panels coupled together at a plurality of fold lines, the plurality of panels including a receiving panel;

positioning the receiving panel within the opening formed in the rotary head of the machine; and rotating the mandrel about the rotational axis between about 0° and about 450° while the receiving panel is retained within the opening formed in the rotary head to construct the container.

2. A method in accordance with claim 1 further comprising forming at least one manufacturing joint to couple the receiving panel to a second panel of the plurality of panels.

3. A method in accordance with claim 1 wherein rotating the mandrel between about 0° and about 450° further comprises rotating the mandrel between about 0° and about 270° .

4. A method in accordance with claim 1 wherein rotating the mandrel between about 0° and about 450° further comprises rotating the mandrel between about 360° and about 450° .

5. A method in accordance with claim 1 wherein rotating the mandrel between about 0° and about 450° further comprises rotating the mandrel in at least one of a clockwise rotational direction and a counterclockwise rotational direction.

6. A method in accordance with claim 1 wherein rotating the mandrel between about 0° and about 450° further comprises rotating the mandrel at one of a constant rotational speed and a variable rotational speed.

7. A method in accordance with claim 1 wherein rotating the mandrel between about 0° and about 450° further comprises rotating the mandrel one of continuously and discountinuously.

8. A method in accordance with claim 1 further comprising wrapping the blank of sheet material about the plurality of side faces of the rotary head as the mandrel rotates about the rotational axis.

9. A method in accordance with claim 1 further comprising folding each panel of the plurality of panels at at least one fold line for facilitating forming one of a side wall and an intermediate side wall of the container.

10. A method in accordance with claim 1, wherein the receiving panel includes a first intermediate side panel, the method further comprising:

positioning the first intermediate side panel within the opening;

rotating the mandrel at least 360° about the rotational axis; and coupling a second intermediate side panel to the first intermediate side panel at a manufacturing joint.

11. A method in accordance with claim 10 wherein coupling a second intermediate side panel to the first intermediate side panel further comprises:

applying an adhesive material to at least one of an exterior surface of the first intermediate side panel and an interior surface of the second intermediate side panel;

folding the second intermediate side panel along a fold line; and contacting the interior surface of the second intermediate side panel to the exterior surface of the first intermediate side panel.

12. A method in accordance with claim 10 wherein rotating the mandrel at least 360° about the rotational axis further comprises folding each panel of the plurality of panels against a corresponding exterior surface of the rotary head as the mandrel rotates.

13. A method in accordance with claim 10 wherein rotating the mandrel at least 360° about the rotational axis further comprises rotating the mandrel about 450° for facilitating coupling the second intermediate side panel to the first intermediate side panel at the manufacturing joint.

14. A method in accordance with claim 10 further comprising wrapping the blank of sheet material about the plurality of side faces of the rotary head as the mandrel rotates about the rotational axis.

15. A method in accordance with claim 1 further comprising:

ejecting the container from about the rotary head; and positioning a second blank of sheet material comprising a plurality of panels coupled together at a plurality of fold lines with respect to the mandrel.

16. A method in accordance with claim 1, wherein the receiving panel includes a divider panel, the method further comprising:

positioning the divider panel of the blank of sheet material within the opening defined within a front face of the rotary head and extending into a first side face of the mandrel and an opposing second side face of the rotary head, the divider panel coupled at a first side edge to a first side panel of the blank of sheet material along a first fold line;

rotating the mandrel in a counterclockwise rotational direction about 270° about the rotational axis;

coupling a tab of the blank of sheet material to an interior surface of a second side panel of the blank of sheet material at a first manufacturing joint, the tab extending from a second side edge of the divider panel along a second fold line and the second side panel folded against the rotary head and opposing the first side panel;

rotating the mandrel at least about 90° in the counterclockwise rotational direction about the rotational axis; and coupling a third side panel to the first side panel at a second manufacturing joint.

17. A method in accordance with claim 16 wherein coupling a tab of the blank of sheet material to an interior surface of a first side panel of the blank of sheet material further comprises:

applying an adhesive material to at least one of one of an interior surface and an exterior surface of the tab and an interior surface of the first side panel;

folding the tab along the first fold line; and adhesively coupling one of the interior surface and the exterior surface of the tab to the interior surface of the first side panel.

18. A method in accordance with claim 16 wherein coupling a third side panel to the first side panel further comprises:

applying an adhesive material to at least one of an interior surface of the third side panel and an exterior surface of the first side panel;

folding the third side panel along a fold line coupling the third side panel to an intermediate side panel; and pressing the interior surface of the third side panel against the exterior surface of the first side panel to adhesively couple the third side panel to the first side panel.

19. A method in accordance with claim 18 wherein coupling a third side panel to the first side panel further comprises forming a divider of the container, the divider compartmentalizing a cavity defined within the container.

20. A method in accordance with claim 16 wherein coupling a third side panel to the first side panel further comprises rotating the rotary head about 180° in the counterclockwise rotational direction about the rotational axis to couple an interior surface of the third side panel to an exterior surface of the first side panel.

21. A method in accordance with claim 20 further comprising applying an adhesive material to at least one of the interior surface of the third side panel and an exterior surface of the first side panel before rotating the rotary head about 180° in the counterclockwise rotational direction.

22. A method in accordance with claim 16 further comprising ejecting the container from about the rotary head.

23. A method in accordance with claim 1, wherein the receiving panel includes a divider panel, the method further comprising:

positioning the divider panel of the blank of sheet material within the opening defined within a front face of the rotary head and extending into a first side face of the rotary head and an opposing second side face of the rotary head, the divider panel coupled at a first side edge along a first fold line to a first portion of the blank of sheet material extending outwardly from the first side face of the rotary head and coupled at an opposing second side edge along a second fold line to a second portion of the blank of sheet material extending outwardly from the second side face of the rotary head;

rotating the rotary head about 90° in a counterclockwise rotational direction about the rotational axis;

folding an interior surface of a first side panel of the first portion against the first side face and folding an exterior surface of a second side panel of the second portion against the second side face;

rotating the rotary head about 180° in the counterclockwise rotational direction about the rotational axis;

coupling a third side panel of the first portion to the second side panel at a first manufacturing joint; and coupling a fourth side panel of the second portion to the first side panel at a second manufacturing joint.

24. A method in accordance with claim 23 wherein coupling a third side panel of the first portion to the second side panel further comprises:

applying an adhesive material to at least one of an interior surface of the second side panel and an interior surface of the third side panel;

folding the third side panel along a fold line coupling the third side panel to an intermediate side panel; and pressing the interior surface the third side panel to the interior surface of the second side panel to adhesively couple the third side panel to the second side panel at the first manufacturing joint.

25. A method in accordance with claim 23 wherein coupling a fourth side panel of the second portion to the first side panel further comprises:

applying an adhesive material to at least one of an exterior surface of the first side panel and an exterior surface of the fourth side panel;

folding the fourth side panel along a fold line coupling the fourth side panel to an intermediate side panel; and pressing the exterior surface the fourth side panel to the exterior surface of the first side panel to adhesively couple the fourth side panel to the first side panel at the second manufacturing joint.

26. A method in accordance with claim 23 further comprising forming a divider of the container, the divider compartmentalizing a cavity defined within the container.

27. A method in accordance with claim 23 further comprising ejecting the container from about the rotary head.

28. An apparatus for constructing a container from a continuous blank of sheet material, the blank comprising a plurality of panels coupled together at a plurality of fold lines, the plurality of panels including a plurality of side panels and a receiving panel, the apparatus comprising:

a frame;

a mandrel comprising a rotary head, a mounting arm, and a rotational axis, the mounting arm having a first end coupled to the frame and an opposing second end coupled to the rotary head, the rotary head defining a plurality of exterior surfaces including a bottom face and a plurality of side faces, each of the plurality of side faces corresponding to a side panel of the plurality of side panels, the rotational axis extending parallel to the mounting arm and perpendicular to the bottom face of the rotary head, the rotary head forming an opening in at least one exterior surface of the plurality of exterior surfaces configured to receive the receiving panel, wherein the rotary head is rotatable about the rotational axis for wrapping the blank of sheet material around the rotary head to form the container, the receiving panel retained within the opening of the rotary head during rotation of the rotary head.

29. An apparatus in accordance with claim 28 wherein the mandrel is rotatable about the rotational axis between about 0° and about 450°.

30. An apparatus in accordance with claim 28 wherein the mandrel is rotatable about the rotational axis between about 0° and about 270°.

31. An apparatus in accordance with claim 28 wherein the mandrel is rotatable about the rotational axis between about 180° and about 450°.

32. An apparatus in accordance with claim 28 wherein the opening is defined within a front exterior surface of the rotary head, the opening extending into a first side exterior surface and an opposing second side exterior surface of the rotary head.

33. An apparatus in accordance with claim 28 wherein the mandrel is rotatable in a clockwise direction and a counter-clockwise direction.

34. A combination comprising:

an apparatus of claim 28; and a continuous blank of sheet material having an interior surface and an opposing exterior surface and defining the plurality of side panels each coupled to at least one intermediate side panel at a corresponding fold line, a first intermediate side panel at a first side edge of the blank of sheet material coupled to a second intermediate side panel at an opposing second side edge of the blank of sheet material to construct the container, the receiving panel including one of the first intermediate side panel and the second intermediate side panel, the container having a plurality of side walls and a plurality of intermediate side walls each obliquely angled with respect to adjacent side walls of the plurality of side walls, the container defining a cavity.

35. A combination comprising:

an apparatus of claim 28; and a continuous blank of sheet material having an interior surface and an opposing exterior surface and defining the plurality of side panels each coupled to at least one intermediate side panel at a corresponding fold line, and a divider panel coupled to a first side panel of the plurality of the side panels at a first fold line, the receiving panel including the divider panel, the blank of sheet material configured to form the container having a plurality of side walls and a plurality of intermediate side walls each obliquely angled with respect to adjacent side walls of the plurality of side walls, the container defining a cavity, the divider panel folded at the first fold line to extend inwardly with respect to the first side panel, the divider panel coupled to an interior surface of a second side panel opposing the first side panel at a first manufacturing joint and a third side panel coupled to the first side panel at a second manufacturing joint to at least partially define the cavity.

36. A combination comprising:

an apparatus of claim 28; and a continuous blank of sheet material having an interior surface and an opposing exterior surface and defining the plurality of side panels each coupled to at least one intermediate side panel at a corresponding fold line, and a divider panel coupled to a first side panel of the plurality of the side panels at a first fold line and coupled to a second side panel of the plurality of side panels at a second fold line parallel to the first fold line, the receiving panel including the divider panel, the blank of sheet material configured to form the container having a plurality of side walls and a plurality of intermediate side walls each obliquely angled with respect to adjacent side walls of the plurality of side walls, the container defining a cavity, the divider panel folded at each of the first fold line and the second fold line to extend through the cavity, a third side panel coupled to the first side panel at a first manufacturing joint to form a first side wall of the plurality of side walls and a fourth side panel coupled to the second side panel to form a second side wall of the plurality of side walls opposing the first side wall.

37. A method for constructing a container from a blank of sheet material using a machine, the machine including a frame and a mandrel having a rotary head coupled to a mounting arm, the mounting arm having a first end coupled to the frame and an opposing second end coupled to the rotary head, the rotary head defining a bottom face and a plurality of exterior surfaces including a plurality of side faces, a rotational axis extending parallel to the mounting arm and perpendicular to the bottom face of the rotary head, the rotary head forming an opening in at least one exterior surface of the plurality of exterior surfaces configured to receive a portion of the blank for facilitating forming the blank into a configuration with respect to a shape of the rotary head as the rotary head rotates about the rotational axis, the method comprising:

providing the blank of sheet material comprising a plurality of panels coupled together at a plurality of fold lines;

positioning a first panel of the plurality of panels within the opening formed in the rotary head of the machine; and rotating the rotary head about the rotational axis between about 0° and about 450° while the first panel is retained within the opening formed in the rotary head to construct the container.

* * * * *